US010079087B2

(12) United States Patent
Matsumoto et al.

(10) Patent No.: US 10,079,087 B2
(45) Date of Patent: Sep. 18, 2018

(54) DITHER CURRENT POWER SUPPLY CONTROL METHOD AND DITHER CURRENT POWER SUPPLY CONTROL APPARATUS

(71) Applicant: Mitsubishi Electric Corporation, Tokyo (JP)

(72) Inventors: Shuichi Matsumoto, Tokyo (JP); Masato Nakanishi, Tokyo (JP); Shingo Iguchi, Tokyo (JP); Hiroyuki Arita, Hyogo (JP); Tomoaki Ogata, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 407 days.

(21) Appl. No.: 15/041,205

(22) Filed: Feb. 11, 2016

(65) Prior Publication Data

US 2017/0062110 A1 Mar. 2, 2017

(30) Foreign Application Priority Data

Sep. 2, 2015 (JP) ..... 2015-172616

(51) Int. Cl.

| | |
|---|---|
| ***H01H 47/00*** | (2006.01) |
| ***H01F 7/06*** | (2006.01) |
| ***F02D 41/14*** | (2006.01) |
| ***H01F 7/18*** | (2006.01) |

(52) U.S. Cl.

CPC ..... *H01F 7/064* (2013.01); *F02D 41/1408* (2013.01); *H01F 7/1844* (2013.01); *H01F 2007/1866* (2013.01)

(58) Field of Classification Search

USPC ..... 361/152

See application file for complete search history.

(56) References Cited

U.S. PATENT DOCUMENTS 5,079,498 A * 1/1992 Cleasby ..... H02M 3/157 323/283
5,673,166 A * 9/1997 Hoffman ..... H01H 47/325 361/160

(Continued)

FOREIGN PATENT DOCUMENTS

JP 2009-103300 A 5/2009
JP 2014-197655 A 10/2014

*Primary Examiner* — Ronald W Leja

(74) *Attorney, Agent, or Firm* — Sughrue Mion, PLLC; Richard C. Turner

(57) ABSTRACT

In the dither current power supply control method, in order to prevent occurrence of a difference between the target average current and the detected average current, which is caused when a medium current (I0) between a dither large current (I2) and a dither small current (I1) and a waveform average (Ia) of the dither current are different from each other depending on a response time difference (a–b) between a rise time (b) and a fall time (a) of the dither current, negative feedback control is carried out by using a command medium current corresponding to the target average current corrected by a correction parameter based on experimentally measured data, thereby suppressing occurrence of a transient fluctuation error by the negative feedback control, so that a highly precise and stable load current is acquired.

15 Claims, 14 Drawing Sheets

(56) References Cited

U.S. PATENT DOCUMENTS

| | | | | |
|---|---|---|---|---|
| 6,208,414 | B1 * | 3/2001 | Killpatrick | G01C 19/66 356/459 |
| 7,154,326 | B2 * | 12/2006 | Swanson | H02M 3/156 327/427 |
| 8,118,058 | B2 * | 2/2012 | Cook | F15B 13/0402 137/625.64 |
| 9,543,097 | B2 * | 1/2017 | Suzuki | H01H 47/325 |
| 9,787,315 | B1 * | 10/2017 | Watanabe | H03M 1/1255 |
| 2006/0232306 | A1 * | 10/2006 | Swanson | H02M 3/156 327/110 |
| 2008/0129364 | A1 * | 6/2008 | Cook | F15B 13/0402 327/307 |
| 2010/0108030 | A1 * | 5/2010 | Kusaka | F02D 31/007 123/357 |
| 2017/0062110 | A1 * | 3/2017 | Matsumoto | H01F 7/064 |
| 2017/0287609 | A1 * | 10/2017 | Hotter | F16K 31/0675 |

* cited by examiner

FIG. 3A

FET COMMUTATION (B=A)

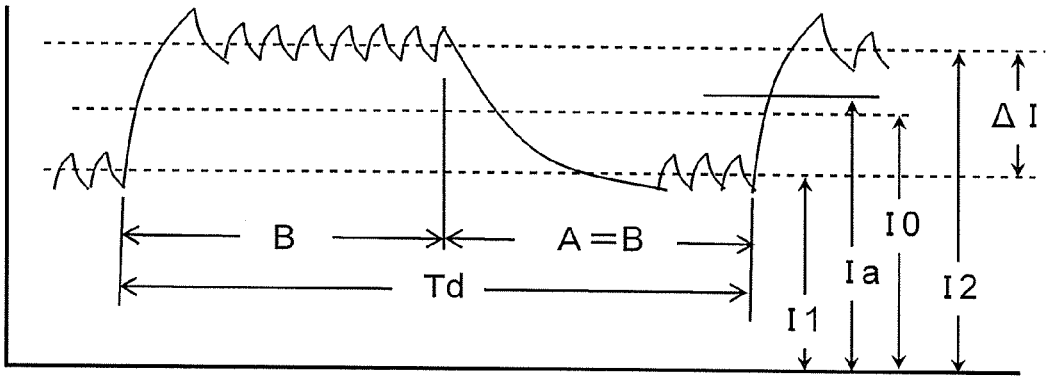

B:DITHER CURRENT LARGE PERIOD
A:DITHER CURRENT SMALL PERIOD
Td:DITHER AMPLITUDE CYCLE
Td=A+B

I2:DITHER LARGE CURRENT
I1:DITHER SMALL CURRENT
ΔI:DITHER AMPLITUDE CURRENT→ΔI=I2-I1
I0:DITHER MEDIUM CURRENT→I0=(I1+I2)/2
∴I2=I0+ΔI/2 I1=I0-ΔI/2

Ia:WAVEFORM AVERAGE CURRENT
Ia=(WAVEFORM AREA)/Td

FIG. 3B

FET COMMUTATION (B<A)

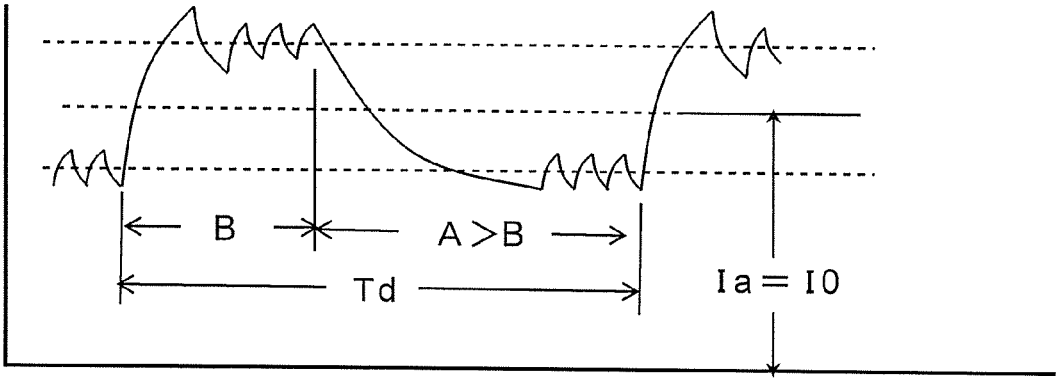

B:DITHER CURRENT LARGE PERIOD
A:DITHER CURRENT SMALL PERIOD
Td:DITHER AMPLITUDE CYCLE
Td=A+B

I0:DITHER MEDIUM CURRENT

Ia:WAVEFORM AVERAGE CURRENT
Ia=(WAVEFORM AREA)/Td

FIG. 4

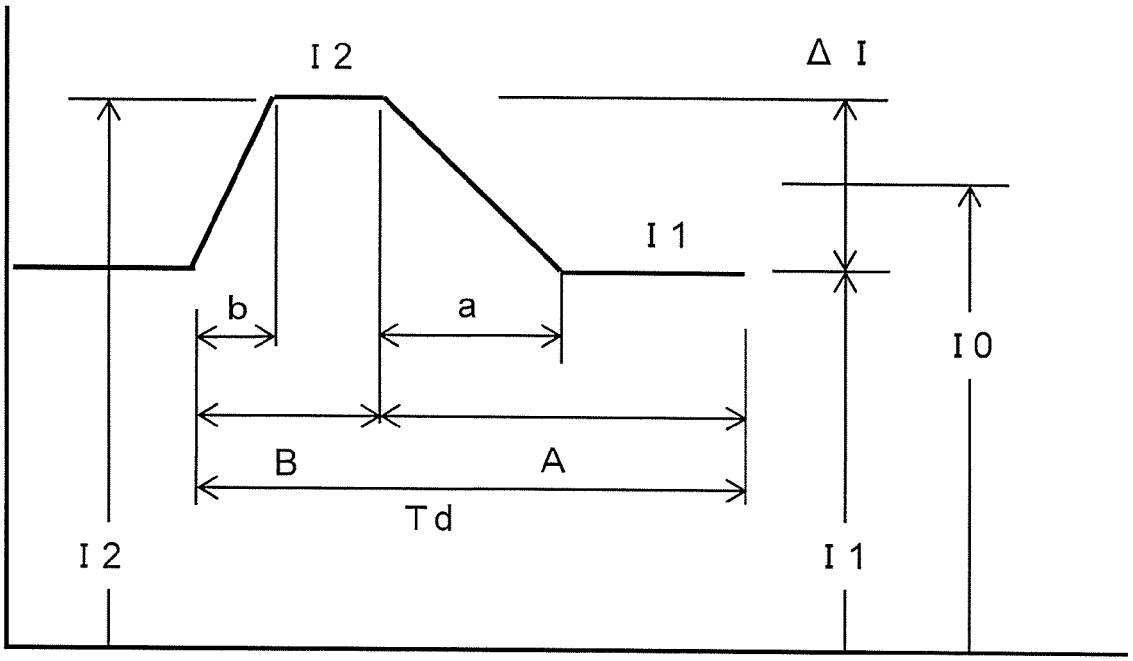

I2:DITHER LARGE CURRENT
I1:DITHER SMALL CURRENT
ΔI:DITHER AMPLITUDE CURRENT
$\Delta I = I2 - I1$
I0:DITHER MEDIUM CURRENT
$I0 = (I2 + I1)/2$
$\therefore I2 = I0 + \Delta I/2$
$I1 = I0 - \Delta I/2$ B:DITHER CURRENT LARGE PERIOD
A:DITHER CURRENT SMALL PERIOD
Td:DITHER AMPLITUDE CYCLE
a:FALL TIME
b:RISE TIME
Ia:WAVEFORM AVERAGE CURRENT

CALCULATION OF WAVEFORM AVERAGE CURRENT $$Ia \times Td = I2(B-b) + I1(A-a) + (b+a)(I2+I1)/2$$
$$= I0(B+A-b-a) + \Delta I(B-A-b+a)/2 + I0(b+a)$$
$$= I0(B+A) + \Delta I(B-A-b+a)/2$$
$$\therefore Ia = I0 + 0.5 \times \Delta I[(B-b)-(A-a)]/Td \quad \ldots (1)$$

<AVERAGE CURRENT>

$Ia=I0+0.5\times\Delta I[(B-b)-(A-a)]/Td$ ...(2)

CALCULATION OF APPROPRIATE MEDIUM CURRENT(B=A)

$Ia=I0+0.5\times\Delta I(a-b)/Td$ ...(2a)

INSTRUCTION CURRENT IS I0 WHEN TARGET CURRENT IS Ia

EXAMPLE 1:$\Delta I$=100mA, T=14msec 600a $I0=Ia-3.57(a-b)$

EXAMPLE 2:$\Delta I$=140mA, T=14msec 600b $I0=Ia-5.0(a-b)$

FIG. 9A

DIODE COMMUTATION(B<A)

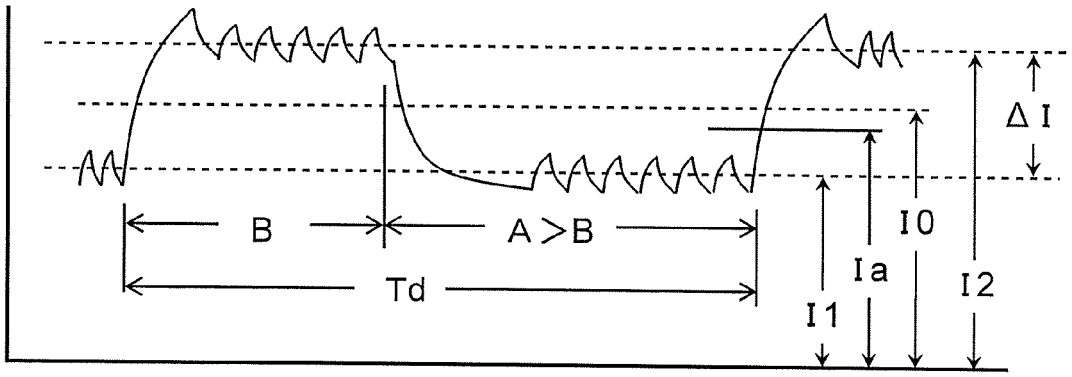

B:DITHER CURRENT LARGE PERIOD
A:DITHER CURRENT SMALL PERIOD
Td:DITHER AMPLITUDE CYCLE
Td=A+B

I2:DITHER LARGE CURRENT
I1:DITHER SMALL CURRENT
ΔI:DITHER AMPLITUDE CURRENT→ΔI=I2-I1
I0:DITHER MEDIUM CURRENT→I0=(I1+I2)/2
∴I2=I0+ΔI/2 I1=I0-ΔI/2

Ia:WAVEFORM AVERAGE CURRENT
Ia=(WAVEFORM AREA)/Td

FIG. 9B

DIODE COMMUTATION(B=A)

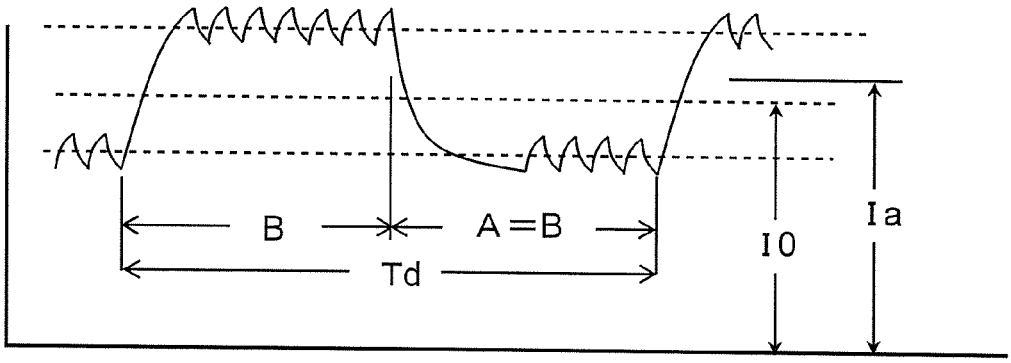

B:DITHER CURRENT LARGE PERIOD
A:DITHER CURRENT SMALL PERIOD
Td:DITHER AMPLITUDE CYCLE
Td=A+B

I0:DITHER MEDIUM CURRENT

Ia:WAVEFORM AVERAGE CURRENT
Ia=(WAVEFORM AREA)/Td

<AVERAGE CURRENT>

$Ia=I0+0.5\times\Delta I[(B-b)-(A-a)]/Td$ ...(2)

CALCULATION OF APPROPRIATE DITHER DUTY

WHEN $(B-b)=(A-a)$, $Ia=I0$ $B+A=Td$, AND THUS $A=[(Td+((a-b))]/2$ ...(EXPRESSION 5a)

$B=[(Td-((a-b))]/2$ ...(EXPRESSION 5b)

<AVERAGE CURRENT>

$Ia=I0+0.5\times\Delta I[(B-b)-(A-a)]/Td$ ...(2)

CALCULATION OF APPROPRIATE DITHER DUTY $A2=[Td+(a2-b2)-(a1-b1)]/2$...(EXPRESSION 6a)

$B2=[Td-(a2-b2)+(a1-b1)]/2$...(EXPRESSION 6a)

$B2/Td=0.5-[(a2-b2)-(a1-b1)]/14$

FIG. 14

FLAG → PLS

CIRCULATE

| NUMBER OF ONs | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | DUTY |
|---|---|---|---|---|---|---|---|---|---|---|---|---|---|---|---|---|---|---|---|---|---|---|---|---|---|
| 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 4.2 |
| 2 | 1 | 0 | 0 | 0 | 0 | 0 | 0 | 0 | 0 | 0 | 0 | 0 | 1 | 0 | 0 | 0 | 0 | 0 | 0 | 0 | 0 | 0 | 0 | 0 | 8.3 |
| 3 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 12.5 |
| 4 | 1 | 0 | 0 | 0 | 0 | 0 | 1 | 0 | 0 | 0 | 0 | 0 | 1 | 0 | 0 | 0 | 0 | 0 | 1 | 0 | 0 | 0 | 0 | 0 | 16.7 |
| 5 | 1 | 0 | 0 | 0 | 0 | 1 | 0 | 0 | 0 | 0 | 1 | 0 | 0 | 0 | 0 | 1 | 0 | 0 | 0 | 0 | 1 | 0 | 0 | 0 | 20.8 |
| 6 | 1 | 0 | 0 | 0 | 1 | 0 | 0 | 0 | 1 | 0 | 0 | 0 | 1 | 0 | 0 | 0 | 1 | 0 | 0 | 0 | 1 | 0 | 0 | 0 | 25.0 |
| 7 | 1 | 0 | 0 | 1 | 0 | 0 | 0 | 1 | 0 | 0 | 1 | 0 | 0 | 0 | 1 | 0 | 0 | 1 | 0 | 0 | 0 | 1 | 0 | 0 | 29.2 |
| 8 | 1 | 0 | 0 | 1 | 0 | 0 | 1 | 0 | 0 | 1 | 0 | 0 | 1 | 0 | 0 | 1 | 0 | 0 | 1 | 0 | 0 | 1 | 0 | 0 | 33.3 |
| 9 | 1 | 0 | 0 | 1 | 0 | 1 | 0 | 0 | 1 | 0 | 0 | 1 | 0 | 0 | 1 | 0 | 1 | 0 | 0 | 1 | 0 | 1 | 0 | 0 | 37.5 |
| 10 | 1 | 0 | 0 | 1 | 0 | 1 | 0 | 1 | 0 | 0 | 1 | 0 | 1 | 0 | 0 | 1 | 0 | 1 | 0 | 1 | 0 | 1 | 0 | 0 | 41.7 |
| 11 | 1 | 0 | 1 | 0 | 1 | 0 | 1 | 0 | 1 | 0 | 1 | 0 | 0 | 1 | 0 | 1 | 0 | 1 | 0 | 1 | 0 | 1 | 0 | 0 | 45.8 |
| 12 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 50.0 |
| 13 | 0 | 1 | 0 | 1 | 0 | 1 | 0 | 1 | 0 | 1 | 0 | 1 | 1 | 0 | 1 | 0 | 1 | 0 | 1 | 0 | 1 | 0 | 1 | 1 | 54.2 |
| 14 | 0 | 1 | 1 | 0 | 1 | 0 | 1 | 0 | 1 | 1 | 0 | 1 | 0 | 1 | 1 | 0 | 1 | 0 | 1 | 0 | 1 | 0 | 1 | 1 | 58.3 |
| 15 | 0 | 1 | 1 | 0 | 1 | 0 | 1 | 1 | 0 | 1 | 1 | 0 | 1 | 1 | 0 | 1 | 0 | 1 | 1 | 0 | 1 | 0 | 1 | 1 | 62.5 |
| 16 | 0 | 1 | 1 | 0 | 1 | 1 | 0 | 1 | 1 | 0 | 1 | 1 | 0 | 1 | 1 | 0 | 1 | 1 | 0 | 1 | 1 | 0 | 1 | 1 | 66.7 |
| 17 | 0 | 1 | 1 | 0 | 1 | 1 | 1 | 0 | 1 | 1 | 0 | 1 | 1 | 1 | 0 | 1 | 1 | 0 | 1 | 1 | 1 | 0 | 1 | 1 | 70.8 |
| 18 | 0 | 1 | 1 | 1 | 0 | 1 | 1 | 1 | 0 | 1 | 1 | 1 | 0 | 1 | 1 | 1 | 0 | 1 | 1 | 1 | 0 | 1 | 1 | 1 | 75.0 |
| 19 | 0 | 1 | 1 | 1 | 1 | 0 | 1 | 1 | 1 | 1 | 0 | 1 | 1 | 1 | 1 | 0 | 1 | 1 | 1 | 1 | 0 | 1 | 1 | 1 | 79.2 |
| 20 | 0 | 1 | 1 | 1 | 1 | 1 | 0 | 1 | 1 | 1 | 1 | 1 | 0 | 1 | 1 | 1 | 1 | 1 | 0 | 1 | 1 | 1 | 1 | 1 | 83.3 |
| 21 | 0 | 1 | 1 | 1 | 1 | 1 | 1 | 1 | 0 | 1 | 1 | 1 | 1 | 1 | 1 | 1 | 0 | 1 | 1 | 1 | 1 | 1 | 1 | 1 | 87.5 |
| 22 | 0 | 1 | 1 | 1 | 1 | 1 | 1 | 1 | 1 | 1 | 1 | 1 | 0 | 1 | 1 | 1 | 1 | 1 | 1 | 1 | 1 | 1 | 1 | 1 | 91.7 |
| 23 | 0 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 95.8 |
| 24 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 100.0 |

DITHER CURRENT POWER SUPPLY CONTROL METHOD AND DITHER CURRENT POWER SUPPLY CONTROL APPARATUS

BACKGROUND OF THE INVENTION

1. Field of the Invention

The present invention relates to improvements in a dither current power supply control method and apparatus, for applying an increase/decrease current to an inductive electric load for driving a reversible positioning actuator, against a static friction resistance acting on a driven body.

2. Description of the Related Art

For example, in a transmission control apparatus, a suspension control apparatus, and the like for a motor vehicle, a proportional solenoid valve for controlling a hydraulic cylinder, which is an actuator, is used. In order to control a position of a movable valve of the proportional solenoid valve, a dither current is supplied to a proportional solenoid coil, which is an inductive electric load. The proportional solenoid coil generates, against a static friction resistance acting on the movable valve and a spring force pressing the movable valve in one direction, a pressing force in the other direction to control the position of the movable valve.

Note that, in the inductive electric load, a response delay is generated in an increase/decrease in a load current based on a time constant Tx=L/R, which is a ratio of the inductance L to the load resistance R. When the rise time from a dither small current I1 to a dither large current I2 and the fall time from the dither large current I2 to the dither small current I1 are different from each other, a value of a dither medium current I0=(I1+I2)/2 of the dither large current I2 and the dither small current I1 and a value of a dither average current Ia acquired by dividing a time integral of the dither current by a dither amplitude cycle Td are different from each other.

Thus, in a case where such negative feedback control as to cause a target average current Iaa and a detected average current Idd to simply match each other is carried out without focusing on the dither medium current I0, consideration needs to be given to such a problem that homogeneous dither control cannot be carried out.

For example, in FIG. 1 of Japanese Patent Application Laid-open No. 2009-103300 (FIG. 1, FIG. 4, FIG. 6, Abstract, and paragraphs [0028], [0029], [0040] and [0045]), "CONTROL METHOD AND CONTROL DEVICE FOR PROPORTIONAL SOLENOID VALVE", an MPU 3 (assumed to be) constructed by a microprocessor includes an opening amount corrector 6 for determining a target average current for a proportional solenoid valve 10, a dither signal generator 7, and a synthesizer 8. A constant current driver 5, which is (assumed to be) hardware externally connected to the MPU 3, carries out negative feedback control so that an instruction current acquired by converting an output of the synthesizer 8 into an analog signal by a D/A converter 4 and a drive current for the proportional solenoid valve 10 match each other. The negative feedback control includes first and second operational amplifiers 31 and 32, an adder 33, a buffer 34, a transistor 35, a current detector 36, and a differentiator/multiplier 37 illustrated in FIG. 6. The differentiator/multiplier 37 is configured to process an increase/decrease in the drive current at high speed.

However, as illustrated in FIG. 4(b) of Japanese Patent Application Laid-open No. 2009-103300, the increase/decrease in the drive current is a sinusoidal wave gradually increasing and decreasing, and in order to acquire a predetermined dither amplitude, a dither cycle may increase and a movable iron 14 (refer to FIG. 2) may be stuck by a static friction resistance.

Moreover, in FIG. 2 of Japanese Patent Application Laid-open No. 2014-197655 (FIG. 2 to FIG. 4, FIG. 15, and paragraphs [0010] to [0017] and [0040]), "CURRENT CONTROL DEVICE AND CURRENT CONTROL PROGRAM", a current control device 10 (assumed to) including a microprocessor is configured to directly output a PWM signal Spwm to a drive circuit 50 for driving and switching a solenoid 95, is constructed by target setting means 20, duty ratio setting means 30, and PWM signal generation means 40 illustrated in FIG. 2. A technology of reducing a period from setting of a basic current value Ib by the target setting means 20 to updating of a duty ratio Rd by the PWM signal generation means 40 is disclosed.

In FIG. 4 of Japanese Patent Application Laid-open No. 2014-197655, in the target setting means 20, a basic setting unit determines the basic current value Ib, a dither average calculation unit 22 calculates a dither average current value Iave2 based on a detected excitation current signal Si, a subtraction unit 23 calculates a deviation value ΔI2, a correction unit 24 generates a proportional integral correction value for the basic current value Ib, a dither setting unit 25 sets a dither current Id, and an addition unit 26 calculates a target current value It.

Moreover, in FIG. 3 of Japanese Patent Application Laid-open No. 2014-197655, in the duty ratio setting means 30, a PWM average calculation unit 31 calculates a PWM average current value Iave1 based on the detected excitation current signal Si, a subtraction unit 32 calculates a deviation ΔI1, a feedback control unit 33 (description error of 34) calculates a duty ratio Rd/fb, a feedforward control unit 34 (description error of 33) calculates a duty ratio Rd/ff, and an addition unit 35 calculates a duty ratio Rd. The duty ratio setting means 30 is configured to adjust the duty ratio Rd of the PWM so that the target current It matches the PWM average current value Iave1.

Note that, in FIG. 2 of Japanese Patent Application Laid-open No. 2014-197655, the PWM signal generation means 40 generates the PWM signal Spwm, and outputs the PWM signal Spwm to the drive circuit, and the target current It is a value periodically changing at the dither cycle that is set to 10 times as long as the PWM cycle of the PWM signal Spwm.

The feedforward control unit 34 (description error of 33) in FIG. 3 of Japanese Patent Application Laid-open No. 2014-197655 is configured to apply the duty ratio Rd/ff so that a fundamental wave of the dither current becomes a triangular wave of FIG. 15 of Japanese Patent Application Laid-open No. 2014-197655. As a result of feedback control at the duty ratio Rd/fb by following the triangular wave, the triangular wave becomes a gentle waveform gradually increasing and decreasing, and in order to acquire a predetermined dither amplitude, the dither cycle may increase and a spool 942 (refer to FIG. 1 of Japanese Patent Application Laid-open No. 2014-197655) may be stuck due to the static friction resistance.

In "CONTROL METHOD AND CONTROL DEVICE FOR PROPORTIONAL SOLENOID VALVE" disclosed in Japanese Patent Application Laid-open No. 2009-103300, the dither current waveform is a sinusoidal wave gently changing, and when the control is carried out by exactly following the sinusoidal wave, the rise time and the fall time of the dither current match each other.

However, when the cycle of the sinusoidal wave is increased so that the current control may follow the sinusoidal wave, there is a problem in that a stationary state of the movable iron 14 occurs to generate the static friction resistance. Moreover, when the cycle of the sinusoidal wave is decreased, there is a problem in that the current control cannot follow and the rise time and the fall time of the dither current do not match each other.

Moreover, it is difficult to calculate a derivative, which is a degree of a change in a deviation signal between a pulsating instruction current and a pulsating detected current, based on the deviation signal, and there is a problem in that precise derivative control cannot be expected.

The same holds true for "CURRENT CONTROL DEVICE AND CURRENT CONTROL PROGRAM" disclosed in Japanese Patent Application Laid-open No. 2014-197655. The dither current waveform is a triangular wave gently changing, and when the control is carried out by exactly following the triangular wave, the rise time and the fall time of the dither current match each other.

However, when the cycle of the triangular wave is increased so that the current control may follow the triangular wave, there is a problem in that a stationary state of the spool 942 occurs to generate the static friction resistance. Moreover, when the cycle of the triangular wave is decreased, there is a problem in that the current control cannot follow and the rise time and the fall time of the dither current do not match each other.

Moreover, a calculation method for the PWM average current value Iave1 and a method for the feedforward control of FIG. 3 are not described at all, but a highly responsive microprocessor and a highly responsive AD converter are considered to be necessary.

SUMMARY OF THE INVENTION

The present invention has been made in view of the above-mentioned problems, and therefore has a first object to provide a dither current power supply control method for setting such an instruction current that a detected average current corresponding to a target average current is acquired even when a difference exists between a rise time and a fall time of a dither current, to thereby decrease a response dependency of feedback control on a fluctuating target current and carry out stable current control.

Moreover, a second object of the present invention is to provide a dither current power supply control apparatus for generating an instruction current with which a planned target average current is estimated to be acquired by using a correction parameter measured on an experimental stage, and superimposing a pulsating dither current on the instruction current, to thereby acquire a stable and highly precise energization current by using a simple calculation control circuit unit.

According to one embodiment of the present invention, there is provided a dither current power supply control method, which comprises calculation control step for generating, for an inductive electric load for driving an actuator having a sliding resistance, a command signal for an instruction current corresponding to a target average current Iaa so that the target average current Iaa and a detected average current Idd match each other, to thereby carry out negative feedback control on an energization current, the target average current Iaa being added with a predetermined dither amplitude current ΔI determined by the sliding resistance, the dither current power supply control method including:

setting the dither amplitude current ΔI as a deviation value ΔI=I2−I1 between a saturation estimated value I2 of a dither large current in a dither current large period B within a dither amplitude cycle Td and a saturation estimated value I1 of a dither small current in a dither current small period A (A=Td−B) within the dither amplitude cycle Td so that (Expression 1) is established when a dither medium current is expressed by I0=(I2+I1)/2, $$I2=I0+\Delta I/2, I1=I0-\Delta I/2 \quad \text{(Expression 1);}$$

calculating a waveform average current Ia by (Expression 2), $$Ia=[I2\times(B-b)+I1\times(A-a)+I0\times(b+a)]/Td=I0+0.5\times\Delta I[(B-b)-(A-a)]/Td \quad \text{(Expression 2),}$$

where b represents arise time during which the energization current increases from the dither small current I1 to the dither large current I2, and a represents a fall time during which the energization current decreases from the dither large current I2 to the dither small current I1, the waveform average current Ia being a value acquired by dividing a time integral of the energization current during the dither amplitude cycle Td by the dither amplitude cycle Td, the dither medium current I0 being calculated so that the waveform average current Ia matches the target average current Iaa, the dither medium current I0 serving as the instruction current for acquiring the target average current Iaa;

energizing and driving, on an experimental stage, the inductive electric load, which is a sample, with the dither large current I2 and the dither small current I1 in the dither amplitude cycle Td, and acquiring, through a measurement or a simulation on a computer, experimentally measured data of a response time difference (a−b) between the rise time b and the fall time a corresponding to the dither medium current I0 on a plurality of stages acquired in the energizing and driving;

storing, on a manufacturing/assembly stage, an approximation equation or a data table of "dither medium current I0 to average response time difference ((a−b))" calculated based on an average of the experimentally measured data acquired with a plurality of samples as a correction parameter in a program memory configured to cooperate with a microprocessor serving as a calculation control means for performing the calculation control step; and reading and setting, as a first step of an actual operation stage, the given target average current Iaa and the dither amplitude current ΔI; calculating, as a second step, the instruction current that establishes such a relationship that the waveform average current Ia represented as Expression (2) matches the given target average current Iaa and a dither duty Γ=B/Td, which is a ratio of the dither current large period B to the dither amplitude cycle Td, and setting the instruction current as the dither medium current I0; and carrying out, as a third step, negative feedback by the calculation control means so as to establish such a relationship that the detected average current Idd of the energization current and the target average current Iaa, namely, the waveform average current Ia, match each other.

According to one embodiment of the present invention, there is provided a dither current power supply control apparatus, including a calculation control circuit unit for generating, depending on an energization current to a proportional solenoid coil, which is an inductive electric load, for a proportional solenoid valve, which is an actuator for carrying out proportional control on a liquid pressure, a command signal for an instruction current corresponding to a target average current Iaa for the proportional solenoid coil so that the target average current Iaa and a detected average current Idd match each other, to thereby carry out negative feedback control on the energization current, the target average current Iaa being added with a predetermined dither amplitude current ΔI determined by a sliding resistance of a movable valve of the proportional solenoid valve.

The proportional solenoid coil is connected in series to a drive switching device for intermittently controlling the energization current of the proportional solenoid coil and connected in series to a current detection resistor, and includes a commutation circuit device connected in parallel with a series circuit of the proportional solenoid coil and the current detection resistor.

The calculation control circuit unit includes mainly a microprocessor configured to cooperate with a program memory and a calculation RAM memory, and the program memory includes a control program serving as current control means.

The current control means includes:

target average current setting means for setting the target average current Iaa corresponding to a target pressure with use of a pressure-to-current conversion table;

dither amplitude current setting means for setting a target dither amplitude current ΔI;

instruction current setting means based on a dither combined current acquired by adding the target average current Iaa and the dither amplitude current ΔI to each other; and first correction means or second correction means.

Then, a deviation value between the target average current Iaa generated by the target average current setting means and the detected average current Idd is algebraically added to the target average current Iaa via proportional/integral means, thereby serving as a combined target current It.

The dither amplitude current setting means is configured to repeatedly generate a dither large current I2 and a dither small current I1, which are command signals acquired by adding and subtracting a half of the target dither amplitude current ΔI to and from a dither medium current I0 as a reference with a dither amplitude cycle Td=A+B including a dither current large period B and a dither current small period A.

The instruction current setting means is configured to determine the dither large current I2 and the dither small current I1 based on the dither amplitude current ΔI set by the dither amplitude current setting means and the dither medium current I0 determined based on the combined target current It.

The first correction means is instruction current correction means for acting on the instruction current setting means to correct, with use of a correction parameter measured on an experimental stage, fluctuation errors in a rise time b and a fall time a of the energization current that fluctuate depending on magnitudes of the dither medium current I0 and the dither amplitude current ΔI, and for setting an instruction current having a value different from a value of the target average current Iaa as the dither medium current I0.

The second correction means is dither duty correction means for acting on the dither current amplitude setting means to set a dither duty Γ=B/Td, which is a ratio of the dither current large period B to the dither amplitude cycle Td, so as to establish such a relationship that the target average current Iaa and the dither medium current I0 match each other.

As described above, according to the dither current power supply control method of the one embodiment of the present invention, the dither medium current serving as the instruction current is determined so that the waveform average current of the energization current to the inductive electric load matches the target average current, and an operation is performed with the instruction current in which the fluctuation errors in the rise time and the fall time that fluctuate depending on the magnitudes of the dither medium current and the dither amplitude current are corrected on the actual operation stage with use of the correction parameter measured on the preliminary experimental stage.

Thus, the negative feedback control is carried out by using the instruction current generated on the assumption that the planned target average current is acquired therewith, and hence there is an effect that the occurrence of a transient fluctuation error in automatic control is suppressed, and even when a control error is included in the detected average current corresponding to the instruction current due to other factors, the control error is automatically corrected by the negative feedback control, and highly precise energization control may be stably carried out.

As described above, the dither current power supply control apparatus according to the one embodiment of the present invention includes the instruction current setting means and the instruction current correction means or the dither duty correction means in order to acquire the target average current and the dither amplitude current given by the target average current setting means and the dither amplitude current setting means, and is configured to set the dither medium current or the dither duty so as to establish such a relationship that the energization average current of the proportional solenoid coil is equal to the target average current.

Thus, the instruction current on the assumption that the planned target average current is acquired therewith is generated by using the correction parameter measured on the experimental stage. Consequently, there is an effect that the occurrence of a transient fluctuation error in automatic control is suppressed, and a stable and highly precise energization current may be acquired by using the simple calculation control circuit unit.

BRIEF DESCRIPTION OF THE DRAWINGS

FIG. 3A and FIG. 3B are characteristic diagrams for showing current waveforms by the current control block of FIG. 2.

FIG. 4 is a characteristic diagram for showing a schematic current waveform, which is a simplified representation of the current waveforms of FIG. 3A and FIG. 3B.

FIG. 9A and FIG. 9B are characteristic diagrams for showing current waveforms by the current control block of FIG. 8.

FIG. 14 is a data map for showing bit patterns in the case of FIG. 11.

DETAILED DESCRIPTION OF THE PREFERRED EMBODIMENTS

First Embodiment

(1) Detailed Description of Configuration

Figure 1:
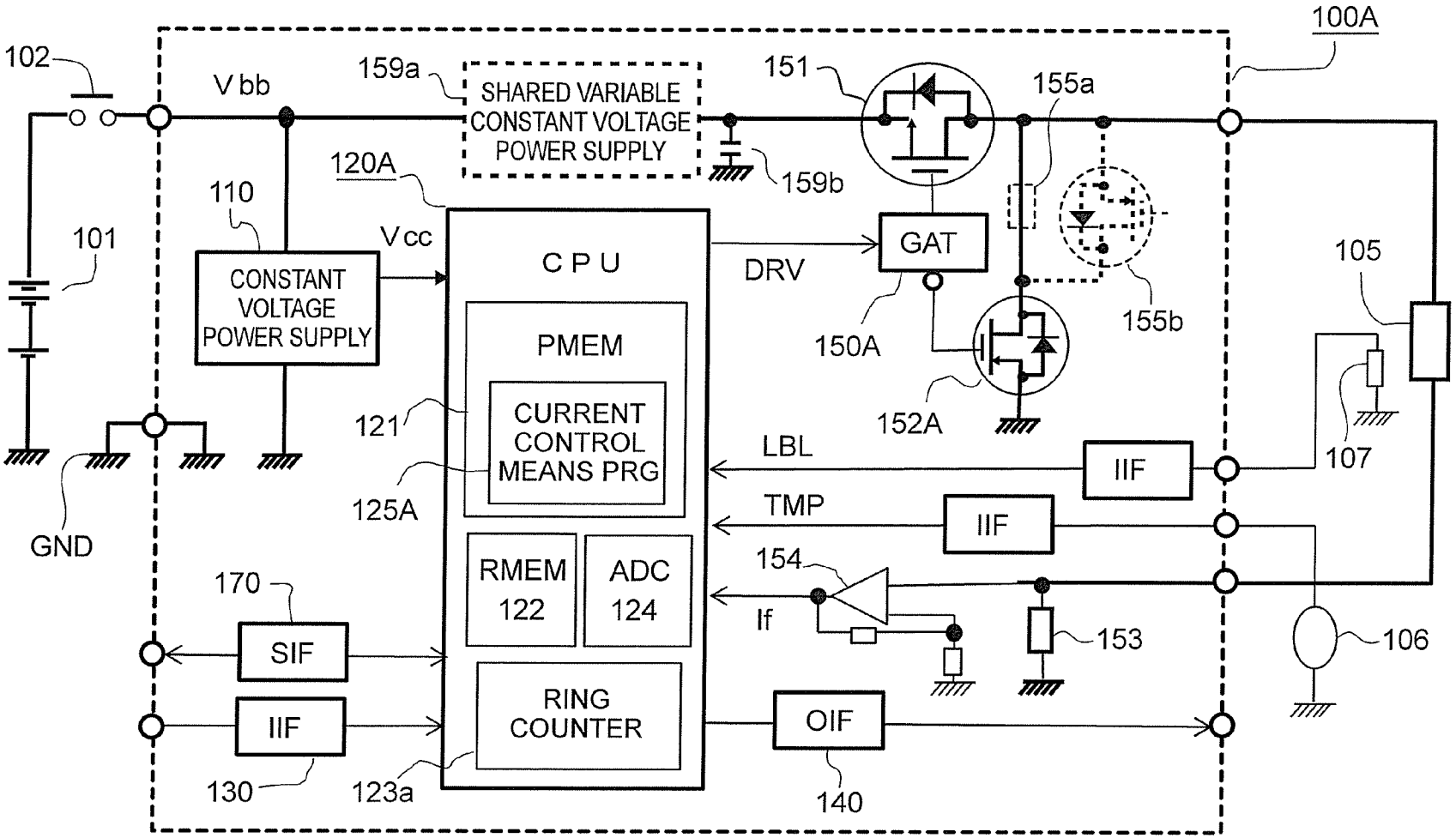
FIG. 1 is an overall circuit block diagram for illustrating a dither current power supply control apparatus according to a first embodiment of the present invention.

Now, a description is given of FIG. 1, which is an overall circuit block diagram for illustrating an apparatus according to a first embodiment of the present invention.

In FIG. 1, a dither current power supply control apparatus 100A supplies an excitation current including a dither current to a proportional solenoid coil 105 provided for each of a plurality of hydraulic solenoid valves for selecting a shift position in, for example, a transmission for a motor vehicle, and is configured to receive an application of a power supply voltage Vbb from an external power supply 101, which is an in-vehicle battery, via an output contact 102 of a power supply relay energized when a power supply switch (not shown) is closed.

Note that, a label resistor 107 for correcting an individual variation fluctuation in an excitation current-to-hydraulic pressure characteristic is provided for each of the plurality of proportional solenoid coils 105. A temperature sensor 106 for measuring an oil temperature representing an environmental temperature of the transmission is provided in the transmission.

The dither current power supply control apparatus 100A is mainly constructed by a calculation control circuit unit 120A including a microprocessor CPU. To the calculation control circuit unit 120A, a control voltage Vcc, which is a stabilized voltage of, for example, DC 5 V, is applied via a constant voltage power supply 110.

The calculation control circuit unit 120A is constructed by a nonvolatile program memory 121, a RAM memory 122 for calculation processing, a ring counter 123*a* described later, and a multi-channel AD converter 124. In the program memory 121, a control program serving as current control means 125A described later, and a nonvolatile data memory region for storing a correction parameter are provided.

An input interface circuit 130 connects input signals to input ports of the calculation control circuit unit 120A, each of the input signals being analog or on/off operational, and acquired from a group of input sensors (not shown) such as a gear shift sensor operating in response to a selection position of a gear shift lever, an engine rotational sensor, a vehicle speed sensor, and an accelerator position sensor for detecting a depressing degree of an accelerator pedal.

Note that, the temperature sensor 106 inputs a temperature detection signal TMP to the multi-channel AD converter 124 via the input interface circuit 130, and the label resistor 107 is input to the multi-channel AD converter 124 via the input circuit 130 as a characteristic label signal LBL.

An output interface circuit 140 is connected between an output port of the calculation control circuit unit 120A and a group of electric loads (not shown) such as a hydraulic pump and a hydraulic solenoid valve for forward/backward travel selection.

A drive switching device 151 connected at an upstream position of the proportional solenoid coil 105 is configured to be controlled to turn on/off by a drive pulse signal DRV generated by the calculation control circuit unit 120A via a gate circuit 150A.

A downstream position of the proportional solenoid coil 105 is connected to the ground circuit GND via a current detection resistor 153. A voltage between both ends of the current detection resistor 153 is amplified via an amplifier 154, and a current detection signal If at a voltage proportional to the energization current of the proportional solenoid coil 105 is input to the multi-channel AD converter 124.

A commutation circuit device 152A is connected between a connection point between the drive switching device 151 and the proportional solenoid coil 105 and the ground circuit GND, and is configured so that when the drive switching device 151 opens, an energization current flowing through the proportional solenoid coil 105 is commuted to flow via the current detection resistor 153.

Note that, in this embodiment, the commutation circuit device 152A is a reversely-connected N-channel field effect transistor, and is configured so that when this transistor is open, a commutation current flows through an internal parasitic diode, and when a gate signal is fed from the gate circuit 150A, in place of the internal parasitic diode, the commutation current flows in a direction from the source terminal toward the drain terminal.

Thus, the commutation circuit device 152A is small in a voltage drop by the commutation current, and is thus small in loss. However, when the energization current needs to be quickly attenuated, it is desired to serially connect an attenuation resistor 155*a* represented by the dotted lines. When the energization current needs not to be quickly attenuated, it is desired to short-circuit the attenuation resistor 155*a* by an additional switching device 155*b*.

Moreover, at an upstream position of the drive switching device 151 provided for each of the plurality of the proportional solenoid coils 105, it is desired to provide a shared variable constant voltage power supply 159*a* represented by the dotted lines and a smoothing capacitor 159*b* so that when the drive switching device 151 is completely conducted, a predetermined reference current is supplied even when the power supply voltage Vbb fluctuates or an internal resistance of the proportional solenoid coil 105 fluctuates due to a change in an environmental temperature.

A serial interface 170 connected between the calculation control circuit unit 120A and external apparatus (not shown) is configured so that, for example, a control program and correction parameter data may be transmitted and written from a program tool into the program memory 121, and input/output signals may be communicated to/from an operating engine control apparatus.

Figure 2:
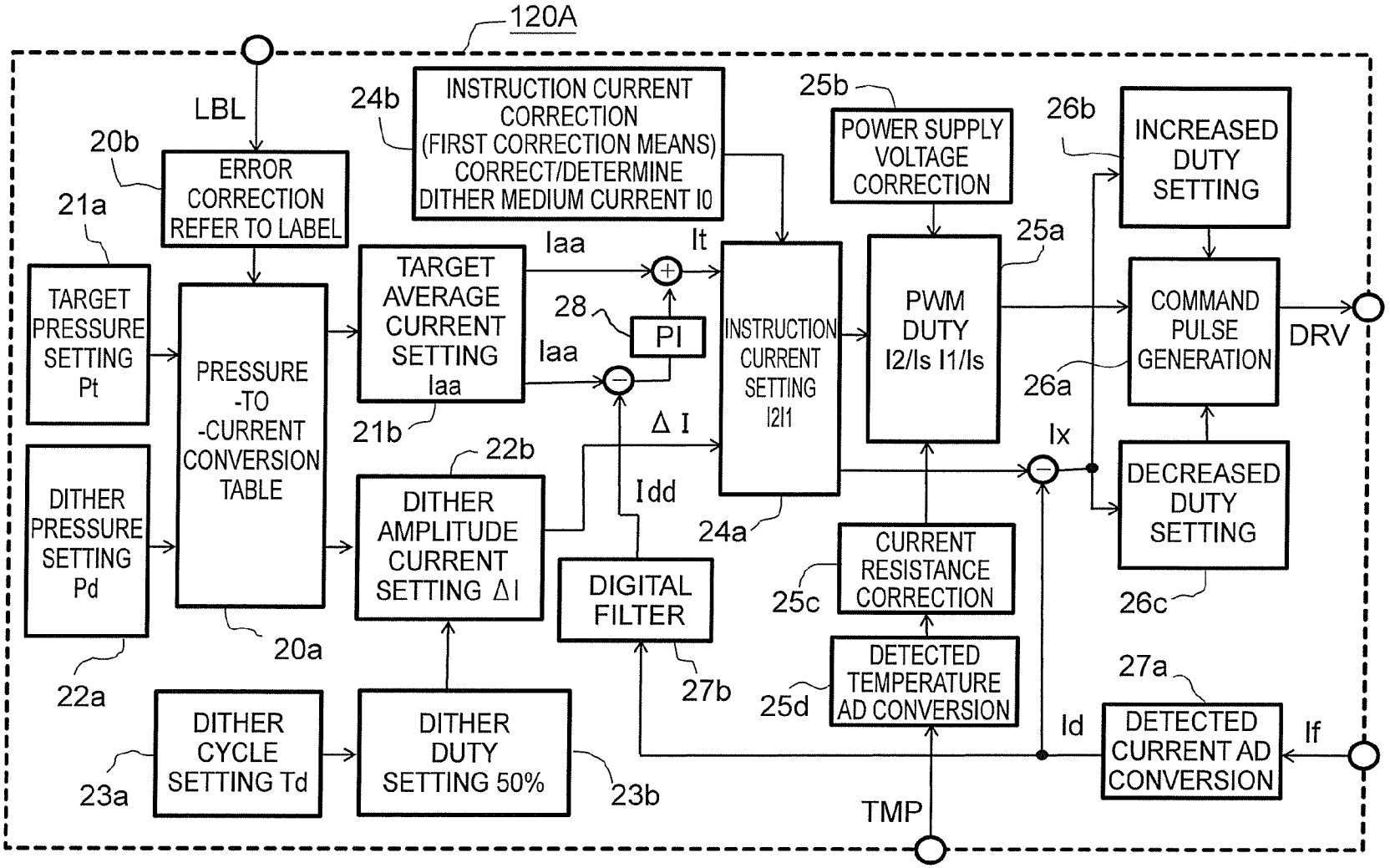
FIG. 2 is a diagram for illustrating a current control block by a calculation control circuit unit of FIG. 1.

Referring to FIG. 2, which is a diagram of a current control block by the calculation control circuit unit 120A of FIG. 1, a description is now given of a configuration of the calculation control circuit unit 120A.

In FIG. 2, a pressure-to-current conversion table 20*a* is stored in advance in the data memory region of the program memory 121, and represents a standard characteristic of a correspondence between the excitation current applied to the proportional solenoid coil 105 and an output pressure of the hydraulic solenoid valve as an approximation equation or a data table of the current to pressure.

Error correction means 20*b* is configured to use the characteristic label signal LBL to read the resistance of the label resistor 107 individually appended to the connected proportional solenoid coil 105, correct the individual variation fluctuation of the current-to-pressure characteristic based on a value of the characteristic label signal LBL, and select a current-to-pressure characteristic closest to the article in question, for example, from a plurality of pieces of standard data relating to the current to pressure.

Target pressure setting means 21*a* is configured to store a target pressure Pt for a specific one of the plurality of proportional solenoid coils 105 calculated by another control program (not shown). Target average current setting means 21*b* is configured to read and set a target average current Iaa acquired by referring to the pressure-to-current conversion table 20*a* in response to the target pressure Pt set by the target pressure setting means 21*a*.

Dither pressure setting means 22*a* sets a dither pressure Pd overcoming the static friction resistance acting on the movable valve of the hydraulic solenoid valve.

Dither amplitude current setting means 22*b* is configured to calculate a dither amplitude current ΔI acquired by referring to the pressure-to-current conversion table 20*a* in response to the dither pressure Pd set by the dither pressure setting means 22*a*.

Dither cycle setting means 23*a* considers the dither pressure Pd set by the dither pressure setting means 22*a* and a weight of the movable valve to set the dither amplitude cycle Td required for slightly vibrating the movable valve.

Dither duty setting means 23*b* sets a dither duty Γ=B/Td for a dither current large period B and a dither current small period A described later referring to FIG. 3A and FIG. 3B, and in this embodiment, the dither duty is set to 50%.

On this occasion, detected current feedback input means 27*a* is configured to update and store a current value of a detected current Id acquired as a digital value by applying a digital conversion by the multi-channel AD converter 124 to a current detection signal If, which is an output signal of the amplifier 154 of FIG. 1.

The digital filter 27*b* calculates a moving average of the detected current Id during a period of the smoothing time constant Tf as a detected average current Idd, and a smoothing time constant Tf is a valve more than a dither amplitude cycle Td.

Proportional/integral means 28 generates an error signal including a component proportional to the deviation value between the target average current Iaa set by the target average current setting means 21*b* and the detected average current Idd and a temporal integral component of the deviation value.

Instruction current setting means 24*a* sets a dither large current I2 and a dither small current I1 based on a combined target current It acquired by adding the target average current Iaa set by the target average current setting means 21*b* and the error signal including the proportional/integral components generated by the proportional/integral means 28.

Instruction current correction means 24*b* (first correction means) is configured to calculate, based on a correction parameter described later, a dither medium current I0 serving as an instruction current corresponding to the combined target current It. Note that, relationships among the dither large current I2, the dither small current I1, the dither medium current I0, and the dither amplitude current ΔI herein are represented as (Expression 1).

$$I2=I0+\Delta I/2, I1=I0-\Delta I/2 \quad \text{(Expression 1)}$$

Thus, ΔI=I2−I1 and I0=(I2+I1)/2 are established, and the dither medium current I0 and a waveform average current Ia, which is an average of the dither current waveform, do not thus always match each other.

The instruction current correction means 24*b* is configured to calculate the dither medium current I0 so that the given combined target current It and the waveform average current Ia match each other.

PWM duty setting means 25*a* is configured to set a count S until a close period τon of the drive switching device 151 arrives on a ring counter 123*a* initialized when a PWM cycle τ is reached by counting clock signals N times, and to actually set the count S so that a ratio γ2=I2/Is of the dither large current I2 to a reference current Is or a ratio γ1=I1/Is of the dither small current I1 to the reference current Is is equal to a PWM duty γ=τon/τ=S/N.

Note that, the reference current Is is, for example, a rated current of the proportional solenoid coil 105. For example, when a resistance of the proportional solenoid coil 105 at the reference temperature of 20° C. is a reference resistance R0 and the drive switching device 151 is closed while setting the PWM duty γ to 1, the voltage applied to the proportional solenoid coil 105 is a reference voltage V0=Is×R0.

Power supply voltage correction means 25*b* is configured to multiply the PWM duty γ=τon/τ by a reciprocal of a voltage correction coefficient Ke=Vbb/V0, which is a ratio of the current power supply voltage Vbb to the reference voltage V0, and to reduce the PWM duty γ when the power supply voltage Vbb is more than the reference voltage V0.

Detected temperature input means 25*d* uses the multi-channel AD converter 124 to apply a digital conversion to the temperature detection signal TMP acquired from the temperature sensor 106, and inputs the converted temperature detection signal TMP to current resistance correction means 25*c*.

The current resistance correction means 25*c* calculates a load resistance R of the proportional solenoid coil 105 at the current temperature from an approximation equation of a temperature-to-resistance characteristic of the proportional solenoid coil 105, and determines a correction duty acquired by multiplying the PWM duty γ=τon/τ by a resistance correction coefficient Kr=R/R0, which is a ratio of the load resistance R to the reference resistance R0.

When the shared variable constant voltage power supply 159*a* of FIG. 1 is used, the correction of the PWM duty γ by the power supply voltage correction means 25*b* and the current resistance correction means 25*c* is unnecessary.

Command pulse generation means 26*a* is mainly constructed by the ring counter 123*a*, and is configured to generate, based on the PWM duty γ set by the PWM duty setting means 25*a*, the drive pulse signal DRV, which has the PWM cycle τ and the on period τon, and the drive switching device 151 is controlled to turn on/off by the drive pulse signal DRV.

Increased duty setting means 26*b* acts when the detected current Id is excessively less than the target dither large current I2, and an absolute value of a deviation current Ix, which is a deviation value between the instruction current set by the instruction current setting means 24*a* and the detected current Id, is equal to or more than the first threshold, to thereby temporally increase the PWM duty γ=τon/τ of the drive pulse signal DRV generated by the command pulse generation means 26*a*, and after a time point when the detected current Id increases, approaches, and passes the target dither large current I2, to return the PWM duty to the PWM duty $\gamma=\tau on/\tau$ specified by the PWM duty setting means 25*a*.

The decreased duty setting means 26*c* acts when the detected current Id is excessively more than the target dither small current I1, and an absolute value of the deviation current Ix, which is the deviation value between the instruction current set by the instruction current setting means 24*a* and the detected current Id, is equal to or more than the second threshold, to thereby temporally decrease the PWM duty $\gamma=\tau on/\tau$ of the drive pulse signal DRV generated by the command pulse generation means 26*a*, and after a time point when the detected current Id decreases, approaches, and passes the target dither small current I1, to return the PWM duty to the PWM duty $\gamma=\tau on/\tau$ specified by the PWM duty setting means 25*a*.

Note that, one dither amplitude cycle Td is an integer multiple (such as 10 to 20 times) of the PWM cycle $\tau$, and an inductive time constant Tx=L/R, which is a ratio of the inductance L of the proportional solenoid coil 105 to the load resistance R, is less than the dither amplitude cycle Td and sufficiently more than the PWM cycle $\tau$.

(2) Detailed Description of Actions/Operations and Method

A detailed description is now sequentially given of actions/operations and a control method for the apparatus constructed as in FIG. 1 and FIG. 2 according to the first embodiment of the present invention with reference to characteristic diagrams shown in FIG. 3A and FIG. 3B to FIG. 6.

First, in FIG. 1 and FIG. 2, when the power supply switch (not shown) is closed, the output contact of the power supply relay 102 closes, and the power supply voltage Vbb is applied to the dither current power supply control apparatus 100A.

As a result, the constant voltage power supply 110 generates the control voltage Vcc, which is a stabilized voltage of, for example, DC 5 V, and the microprocessor CPU constructing the calculation control circuit unit 120A starts a control operation.

The microprocessor CPU operates in response to operation states of the input sensor group (not shown) input from the input interface circuit 130 and contents of the control programs stored in the nonvolatile program memory 121, generates load drive command signals directed to the electric load group (not shown) connected to the output interface circuit 140, and carries out, via the drive switching device 151, on/off control for each of the plurality of proportional solenoid coils 105, which are specific electric loads among the electric load group, to control the energization current therefor.

The drive switching device 151 is controlled to turn on/off by the drive pulse signal DRV generated by the command pulse generation means 26*a* illustrated in FIG. 2. The drive pulse signal DRV generates the on command only for the on period $\tau on$ in the PWM cycle $\tau$, and, as a result, an average voltage of $Vbb\times\tau on/\tau$ is applied to the proportional solenoid coil 105.

The instruction current setting means 24*a* cooperates with the dither amplitude current setting means 22*b* and the instruction current correction means 24*b* to determine the dither medium current I0 corresponding to the combined target current It to calculate the dither large current I2 and the dither small current I1 represented as Expression 1, and instructs the PWM duty $\gamma=\tau on/\tau$ directed to the command pulse generation means 26*a* via the PWM duty setting means 25*a*.

The combined target current It is an algebraic sum of the target average current Iaa set by the target average current setting means 21*b* and the error signal generated by the proportional/integral means 28. To the proportional/integral means 28, a deviation signal between the target average current Iaa set by the target average current setting means 21*b* and the detected average current Idd calculated by the digital filter 27*b* is input.

The smoothing time constant Tf of the digital filter 27*b* is more than the dither amplitude cycle Td. The detected average current Idd corresponds to the waveform average current Ia of the pulsating dither current.

In contrast, the detected current Id acquired by simple digital conversion of the current detected signal If acquired from the amplifier 154 represents a current value of the energization current pulsating depending on the large and small dither currents.

The increased duty setting means 26*b* and the decreased duty setting means 26*c* are configured to assist the command pulse generation means 26*a* in quickly increasing/quickly decreasing the PWM duty $\gamma$ in response to the deviation current Ix between the dither large current I2 and the dither small current I1 alternately generated as command signals by the instruction current setting means 24*a* and the detected current Id, to thereby attain a quick current change.

Thus, the frequently increasing/decreasing dither amplitude current is not directly subject to the negative feedback control by the calculation control means. Rather, an indirect reflection is realized by negative feedback control of the waveform average current of the dither amplitude current without the necessity to respond to the energization current frequently changing in a predetermined increase/decrease pattern, and hence a control characteristic is stabilized, and simple calculation control means may be applied.

In FIG. 3A and FIG. 3B, which are characteristic diagrams for showing current waveforms by the current control block of FIG. 2, FIG. 3A is a diagram in a case where the commutation circuit device 152A is the field effect transistor illustrated in FIG. 1, and does not include the attenuation resistor 155*a* and the additional switching device 155*b* represented by the dotted lines, and FIG. 3A is particularly an illustration of current waveforms in a case where the dither current large period B and the dither current small period A are set to be equal to each other.

As apparent from FIG. 3A, the rise time from the dither small current I1 to the dither large current I2 is less than the fall time from the dither large current I2 to the dither small current I1, and as a result, the waveform average current Ia is a larger value than the dither medium current I0.

In contrast, FIG. 3B is a diagram for showing a current waveform in a case where the dither current large period B is shortened so that the waveform average current Ia and the dither medium current I0 match each other.

Note that, a relationship between the waveform average current Ia and the dither medium current I0 is described in more detail with reference to FIG. 4.

In FIG. 4, which is a characteristic diagram for showing a schematic current waveform that represents the current waveforms of FIG. 3A and FIG. 3B in a simplified manner, the rise time from the dither small current I1 to the dither large current I2 is denoted by b, the fall time from the dither large current I2 to the dither small current I1 is denoted by a, and referring to (Expression 1), an area of the dither current waveform in the dither amplitude cycle Td is calculated as follows.

$$(\text{Area of period } b)=b\times(I1+I2)/2=b\times I0$$

$$(\text{Area of period } (B-b))=(B-b)\times I2=(B-b)\times(I0+\Delta I/2)$$

$$(\text{Area of period } a)=a\times(I1+I2)/2=a\times I0$$

$$(\text{Area of period } (A-a))=(A-a)\times I1=(A-a)\times(I0-\Delta I/2)$$

$$(\text{Overall area in period } Td)=Td\times I0+[(B-b)-(A-a)]\times\Delta I/2$$

Thus, the waveform average current Ia acquired by dividing the overall area in the period Td by the dither amplitude cycle Td is represented as (Expression 2).

$$Ia=I0+0.5\times\Delta I[(B-b)-(A-a)]/Td \quad \text{(Expression 2)}$$

FIG. 3A is an illustration of a state of (Expression 2), and it is understood that when (B−b)>(A−a), Ia>I0 is established.

Moreover, also in (Expression 2), it is understood that when the dither current large period B or the dither current small period A is adjusted so that (B−b)=(A−a) is established, Ia=I0 shown in FIG. 3B is established.

Thus, in the experimental measurement, when the detected average current Idd is measured with the dither medium current I0 as the instruction current, and the dither current large period B is adjusted so that the dither medium current I0 and the detected average current Idd (namely, waveform average current Ia) match each other, at this time point, such a relationship that (B−b)=(A−a) and A+B=Td is established, and hence (Expression 3a), (Expression 3b) and (Expression 3c) are acquired.

$$A=[(Td+(a-b)]/2 \quad \text{(Expression 3a)}$$

$$B=[(Td-(a-b)]/2 \quad \text{(Expression 3b)}$$

$$\therefore (a-b)=A-B=Td-2\times B(=2\times A-Td) \quad \text{(Expression 3c)}$$

Figure 5:
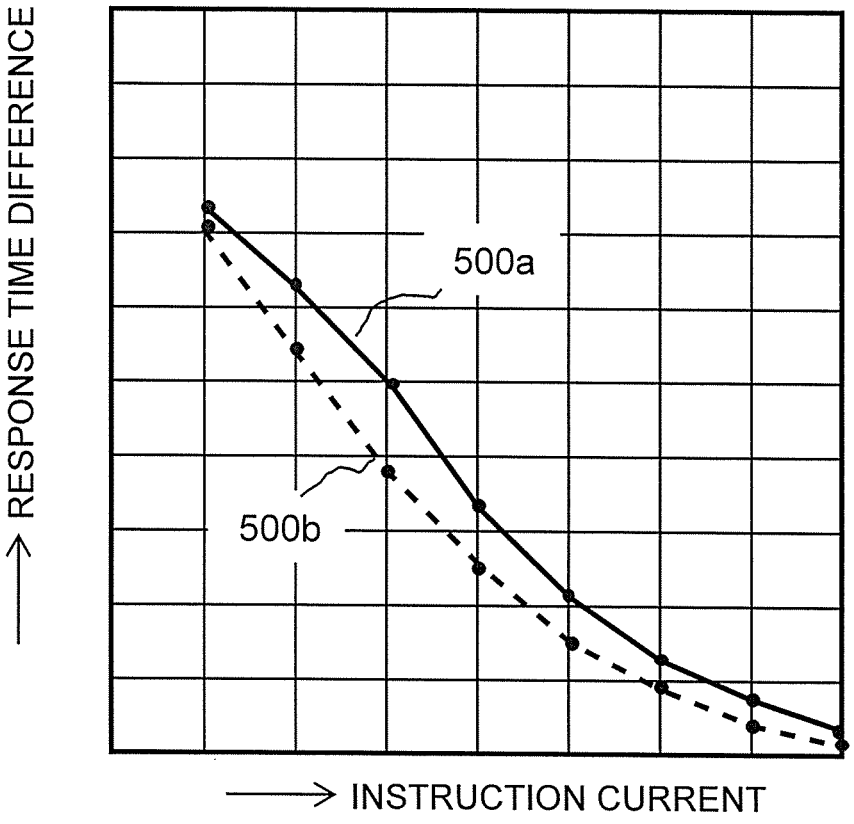
FIG. 5 is an experimental characteristic diagram for showing a relationship between a response time difference and an instruction current in the case of FIG. 1.

An average ((a−b)) of the dither medium current I0 to the response time difference (a−b) is measured by experimentally measuring a plurality of samples, and is shown, in FIG. 5 as an experimental characteristic diagram for showing a relationship of the response time difference to the instruction current.

Note that, in FIG. 5, a characteristic diagram 500*a* is acquired on the condition that the dither amplitude current ΔI is 10% of the maximum value of the target average current Iaa, and a characteristic diagram 500*b* is acquired on the condition that the dither amplitude current ΔI is 140% the maximum value.

How to reflect the average response time difference ((a−b)) measured in this way in an actual operation includes a first correction method and a second correction method.

The first correction method is a correction in which B=A is set in (Expression 2), that is, the dither current large period B and the dither current small period A are set to match each other, and the dither duty Γ=B/Td is fixed to 50%. The relationship between the waveform average current Ia serving as the target average current Iaa and the dither medium current I0 serving as the instruction current in this case is calculated by using (Expression 2a).

$$Iaa=Ia=I0+0.5\times\Delta I\times((a-b)) \quad \text{(Expression 2a)}$$

Figure 6:
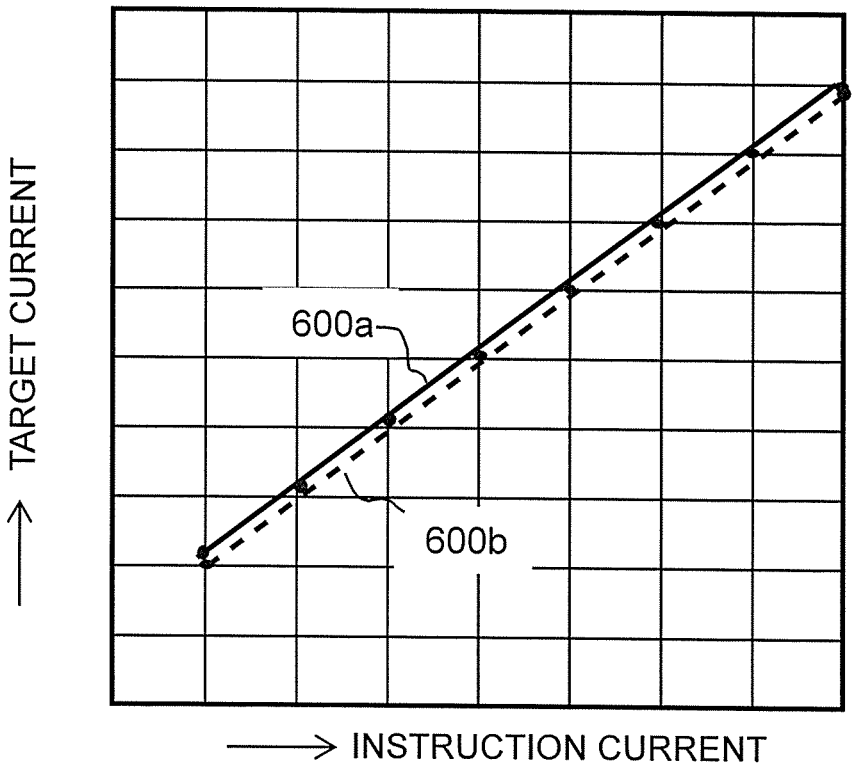
FIG. 6 is a correction characteristic diagram for showing a relationship between a target current and the instruction current in the case of FIG. 1.

FIG. 6 is a correction characteristic diagram for showing the relationship between the target current and the instruction current by the first correction method.

Note that, in FIG. 6, a characteristic diagram 600*a* is acquired on the condition that the dither amplitude current ΔI is 10% of the maximum value of the target average current Iaa, and a characteristic diagram 600*b* is acquired on the condition that the dither amplitude current ΔI is 140% the maximum value.

The second correction method is a correction in which B−b=A−a is set in (Expression 2), and the waveform average current Ia serving as the target average current Iaa and the dither medium current I0 serving as the instruction current are set to match each other, and the dither current large period B or the dither current small period A corresponding to the dither medium current I0 is calculated in accordance with (Expression 5b) or (Expression 5a).

$$A=[(Td+((a-b))]/2 \quad \text{(Expression 5a)}$$

$$B=[(Td-((a-b))]/2 \quad \text{(Expression 5b)}$$

This is applied in a second embodiment of the present invention described later.

In any of the cases, as the average response time difference ((a−b)), an average response time difference corresponding to a medium value between the minimum value and the maximum value of a practical range of the target average current Iaa or corresponding to a specific representative target average current frequently used is applied, or an average response time difference calculated by interpolation by using a plurality of average response time differences relating to the target average current Iaa on the plurality of stages is applied.

(3) Gist and Features of First Embodiment

As apparent from the above description, the dither current power supply control method according to the first embodiment of the present invention is a dither current power supply control method, which comprises calculation control step for generating, for an inductive electric load for driving an actuator having a sliding resistance, a command signal for an instruction current corresponding to a target average current Iaa so that the target average current Iaa and a detected average current Idd match each other, to thereby carry out negative feedback control on an energization current, the target average current Iaa being added with a predetermined dither amplitude current ΔI determined by the sliding resistance.

The dither amplitude current ΔI is set as a deviation value ΔI=I2−I1 between a saturation estimated value I2 of a dither large current in a dither current large period B within a dither amplitude cycle Td and a saturation estimated value I1 of a dither small current in a dither current small period A (A=Td−B) within the dither amplitude cycle Td, and (Expression 1) described above is established when a dither medium current is expressed by I0=(I2+I1)/2.

A waveform average current Ia when a rise time during which the energization current increases from the dither small current I1 to the dither large current I2 is represented by b and a fall time during which the energization current decreases from the dither large current I2 to the dither small current I1 is represented by a is calculated by (Expression 2) described above.

Then, the waveform average current Ia is a value acquired by dividing a time integral of the energization current during the dither amplitude cycle Td by the dither amplitude cycle Td. The dither medium current I0 is calculated so that the waveform average current Ia matches the target average current Iaa. The dither medium current I0 serves as the instruction current for acquiring the target average current Iaa.

On an experimental stage, the inductive electric load, which is a sample, is energized and driven with the dither large current I2 and the dither small current I1 in the dither amplitude cycle Td, and, through a measurement or a simulation on a computer, experimentally measured data of a response time difference (a−b) between the rise time b and the fall time a corresponding to the dither medium current I0 on a plurality of stages acquired in the energizing and driving are acquired.

On a manufacturing/assembly stage, an approximation equation or a data table of "dither medium current I0 to average response time difference ((a−b))" calculated based on an average of the experimentally measured data acquired with a plurality of samples is stored as a correction parameter in a program memory configured to cooperate with a microprocessor serving as a calculation control means for performing the calculation control step.

As a first step of an actual operation stage, the given target average current Iaa and the dither amplitude current ΔI are read and set. As a second step, the instruction current that establishes such a relationship that the waveform average current Ia represented as Expression (2) matches the given target average current Iaa and a dither duty Γ=B/Td, which is a ratio of the dither current large period B to the dither amplitude cycle Td are calculated, and the calculated instruction current is set as the dither medium current I0. As a third step, negative feedback is carried out by the calculation control means so as to establish such a relationship that the detected average current Idd of the energization current and the target average current Iaa, namely, the waveform average current Ia, match each other.

The experimentally measured data is acquired by, while adjusting the dither duty Γ=B/Td for the predetermined dither medium current I0 with the dither amplitude cycle Td=A+B being set constant, measuring the dither current large period B or the dither current small period A at a time point when the detected average current Idd and the dither medium current I0 match each other. The state in which the dither medium current I0 and the detected average current Idd, namely, the waveform average current Ia, match each other means a state in which a difference value (B−b) between the dither current large period B and the rise time b in (Expression 2) and a difference value (A−a) between the dither current small period A and the fall time a are equal to each other, and the dither medium current I0 and the waveform average current Ia match each other. Thus, (Expression 3a) and (Expression 3b) are established.

$$A=[(Td+(a-b)]/2 \quad \text{(Expression 3a)}$$

$$B=[(Td-(a-b)]/2 \quad \text{(Expression 3b)}$$

The correction parameter is the approximation equation or the data table of "dither medium current I0 to average response time difference ((a−b))" acquired by carrying out, in an environment at a reference voltage and a reference temperature, experimental measurement on a plurality of samples of the inductive electric load based on the predetermined dither amplitude cycle Td, the dither amplitude current ΔI determined in correspondence to the target average current Iaa, and the dither medium current I0 on the plurality of stages, calculating the response time difference (a−b) by (Expression 4) based on a dither current large period BOO and a dither current small period A00 actually measured in correspondence to the experimental measurement, and setting an average of the plurality of samples as the average response time difference ((a−b)) for the dither medium current I0.

$$(a-b)=Td-2\times B00(=2\times A00-Td)\rightarrow \text{average}\ ((a-b)) \quad \text{(Expression 4).}$$

As described above, according to claim 2 of the present invention, on the experimental measurement stage, the dither duty is adjusted so that the set dither medium current and the detected average current match each other, and the response time difference, which is the difference between the fall time and the rise time corresponding to the dither medium current is measured.

Thus, on the experimental stage, the rise time and the fall time do not need to be directly observed. Rather, the dither medium current applied on the experimental stage and the detected average current measured in correspondence to the dither medium current are used as the waveform average current to measure the rise fall time and the rise time equivalently, which means that such a feature is provided that a highly precise measurement may be carried out in correspondence to a practical purpose.

This applies to second and third embodiments of the present invention.

On the actual operation stage, a first correction method is applied.

The first correction method involves setting B=A in (Expression 2) so that the dither current large period B and the dither current small period A match each other, to thereby fix the dither duty Γ=B/Td to 50%, and a relationship between the waveform average current Ia serving as the target average current Iaa and the dither medium current I0 serving as the instruction current in the first correction method is calculated by (Expression 2a).

$$Iaa=Ia=I0+0.5\times\Delta I\times((a-b)) \quad \text{(Expression 2a)}$$

As the average response time difference ((a−b)), an average response time difference corresponding to a medium value between a minimum value and a maximum value of a practical range of the target average current Iaa or corresponding to a specific representative target average current frequently used is applied, or an average response time difference calculated by interpolation by using a plurality of average response time differences relating to the target average current Iaa on the plurality of stages is applied.

As described above, according to claim 3 of the present invention, on the experimental measurement stage, the dither duty is adjusted so that the waveform average current and the dither medium current match each other, and the response time difference, which is the difference between the fall time and the rise time corresponding to the dither medium current, is measured. Further, as the first correction method on the actual operation stage, the dither duty is fixed to 50%, the dither medium current corresponding to the waveform average current is calculated by using the average response time difference data acquired on the experimental measurement stage, and the dither medium current is applied as the instruction current corresponding to the target average current.

Thus, such a feature is provided that a simple expression represented as (Expression 2a) is used to correct and set the dither medium current as the instruction current, and hence even when the fall time and the rise time of the dither current fluctuate, an appropriate dither medium current is determined as the instruction current in correspondence to the given target average current, thereby reducing the control error.

As apparent from the above description, the dither current power supply control apparatus according to the first embodiment of the present invention includes the calculation control circuit unit 120A for generating, depending on the energization current to the proportional solenoid coil 105, which is an inductive electric load, for the proportional solenoid valve, which is an actuator for carrying out proportional control on a liquid pressure, a command signal for an instruction current corresponding to a target average current Iaa for the proportional solenoid coil 105 so that the target average current Iaa and a detected average current Idd match each other, to thereby carry out negative feedback control on the energization current, the target average current Iaa being added with a predetermined dither amplitude current ΔI determined by a sliding resistance of a movable valve of the proportional solenoid valve.

The proportional solenoid coil 105 is connected in series to the drive switching device 151 for intermittently controlling the energization current of the proportional solenoid coil 105 and connected in series to the current detection resistor 153, and includes the commutation circuit device 152A connected in parallel with a series circuit of the proportional solenoid coil 105 and the current detection resistor 153.

The calculation control circuit unit 120A includes mainly a microprocessor CPU configured to cooperate with the program memory 121 and the calculation RAM memory 122, and the program memory 121 includes a control program serving as the current control means 125A.

The current control means 125A includes: the target average current setting means 21*b* for setting the target average current Iaa corresponding to a target pressure with use of the pressure-to-current conversion table 20*a*; the dither amplitude current setting means 22*b* for setting a target dither amplitude current ΔI; the instruction current setting means 24*a* based on a dither combined current acquired by adding the target average current Iaa and the dither amplitude current ΔI to each other; and the first correction means 24*b*.

Then, a deviation value between the target average current Iaa generated by the target average current setting means 21*b* and the detected average current Idd is algebraically added to the target average current Iaa via the proportional/integral means 28, thereby serving as a combined target current It.

The dither amplitude current setting means 22*b* is configured to repeatedly generate a dither large current I2 and a dither small current I1, which are command signals acquired by adding and subtracting a half of the target dither amplitude current ΔI to and from a dither medium current I0 as a reference with a dither amplitude cycle Td=A+B including a dither current large period B and a dither current small period A.

The instruction current setting means 24*a* is configured to determine the dither large current I2 and the dither small current I1 based on the dither amplitude current ΔI set by the dither amplitude current setting means 22*b* and the dither medium current I0 determined based on the combined target current It.

The first correction means 24*b* is instruction current correction means for acting on the instruction current setting means 24*a* to correct, with use of a correction parameter measured on an experimental stage, fluctuation errors in a rise time b and a fall time a of the energization current that fluctuate depending on magnitudes of the dither medium current I0 and the dither amplitude current ΔI, and for setting an instruction current having a value different from a value of the target average current Iaa as the dither medium current I0.

The calculation control circuit unit 120A is configured to cause command pulse generation means 26*a* to generate, based on a switching duty determined by the PWM duty setting means 25*a*, a drive pulse signal DRV to directly control the drive switching device 151 to be turned on/off via the gate circuit 150A.

The PWM duty setting means 25*a* is configured to operate in response to an instruction current from the instruction current setting means 24*a* to determine a PWM duty $\gamma=\tau on/\tau$, which is a ratio of a close period τon, which is an on period of the drive switching device 151, to a PWM cycle τ.

A voltage between both terminals of the current detection resistor 153 is input to the calculation control circuit unit 120A via the amplifier 154, and a detected current Id proportional to a digital conversion value of the voltage is smoothed into the detected average current Idd via the digital filter 27*b*.

The PWM duty setting means 25*a* is configured to initially set the PWM duty $\gamma=\tau on/\tau$ so as to match ratios I2/Is and I1/Is, which are ratios of the dither large current I2 and the dither small current I1 to a reference current Is.

The reference current Is is expressed by an energization current V0/R0 acquired when a resistance value of the proportional solenoid coil 105 is a reference resistance R0, and an applied voltage to the proportional solenoid coil 105 when the drive switching device 151 is closed is a reference voltage V0.

The proportional solenoid coil 105 is supplied with power via the shared variable constant voltage power supply 159*a*, and the shared variable constant voltage power supply 159*a* is controlled by negative feedback so that an output voltage of the shared variable constant voltage power supply 159*a* matches a variable voltage Vx that is proportional to a resistance ratio (R/R0) of a current load resistance R of the proportional solenoid coil 105 to the reference resistance R0, or is controlled to be turned on/off at an energization duty corresponding to a value acquired by dividing the resistance ratio by a voltage ratio (Vbb/V0) of a current power supply voltage Vbb to the reference voltage V0.

The PWM duty setting means 25*a* is further configured to determine a correction duty, which is acquired by multiplying the initially set duty $\gamma=\tau on/\tau$ by a reciprocal of a voltage correction coefficient Ke=Vbb/V0, which is a ratio of the current power supply voltage Vbb to the reference voltage V0, by the power supply voltage correction means 25*b*, or acquired by multiplying the initially set duty $\gamma=\tau on/\tau$ by a resistance correction coefficient Kr=R/R0, which is calculated by the current resistance correction means 25*c* and is a ratio of the load resistance R of the proportional solenoid coil 105 at a current temperature to the reference resistance R0.

Then, the dither amplitude cycle Td in the dither amplitude current setting means 22*b* is more than an inductive time constant Tx=L/R, which is a ratio of an inductance L of the proportional solenoid coil 105 to the load resistance R. The PWM cycle τ is less than the inductive time constant Tx. A smoothing time constant Tf by the digital filter 27*b* is more than the dither amplitude cycle Td ($Tf>Td>Tx>\tau$).

The proportional/integral means 28 is configured to carry out, when a setting error occurs in the instruction current setting means 24*a* constructed by the first correction means 24*b*, when a setting error occurs in the dither amplitude current setting means 22*b* constructed by the second correction means 23*c*, or when a setting error occurs in the PWM duty setting means 25*a* constructed by one or both of the current voltage correction means 25*b* and the current resistance correction means 25*c*, negative feedback control to increase and decrease the combined target current It based on an integral of a deviation signal between the target average current Iaa and the detected average current Idd so as to establish such a relationship that the target average current Iaa and the detected average current Idd match each other. An integral time constant Ti of the negative feedback control is more than the dither amplitude cycle Td.

This applies to the second embodiment.

As described above, according to claim 8 of the present invention, in order to acquire the given target average current and dither amplitude current, the instruction current setting means and the instruction current correction means or the dither duty correction means are provided, and the dither medium current or the dither duty is set to establish such a relationship that the energization average current of the proportional solenoid coil is equal to the target average current. Further, the PWM duty setting means for determining the energization duty for controlling to switch the drive switching device of the proportional solenoid coil carries out the negative feedback control so as to correct, when the shared variable constant voltage source is not connected, the PWM duty depending on the load resistance of the proportional solenoid coil at the current power supply voltage or the current temperature, and so as to correct the combined target current based on the integral of the deviation signal between the target average current and the detected average current so that the target average current and the detected average current match each other.

Thus, such a feature is provided that the instruction current correction means or the dither duty correction means and the current voltage correction means or the current resistance correction means may be used to acquire the energization average current corresponding to the target average current, and the control error is suppressed by the proportional/integral means, and, as a result, stable and highly precise negative feedback control may be carried out against fluctuations in wide ranges in the power supply voltage, the load resistance, and the inductance of the load, and a fluctuation in a required range of the target average current.

The calculation control circuit unit 120A further includes at least one of the increased duty setting means 26*b* or the decreased duty setting means 26*c* for operating in response to a deviation current Ix between the detected current Id and the dither large current I2 and the dither small current I1, which are the command signals alternately generated by the instruction current setting means 24*a*.

The increased duty setting means 26*b* is configured to act, when the detected current Id is excessively smaller than the target dither large current I2 and when an absolute value of the deviation current Ix is equal to or more than a first threshold, to temporally increase the PWM duty $\gamma=\tau on/\tau$ of the drive pulse signal DRV generated by the command pulse generation means 26*a*, and to return the PWM duty to the PWM duty $\gamma=\tau on/\tau$ specified by the PWM duty setting means 25*a* after a time point when the detected current Id increases, approaches, and passes the target dither large current I2.

The decreased duty setting means 26*c* is configured to act, when the detected current Id is excessively larger than the target dither small current I1 and when the absolute value of the deviation current Ix is equal to or more than a second threshold, to temporally decrease the PWM duty $\gamma=\tau on/\tau$ of the drive pulse signal DRV generated by the command pulse generation means 26*a*, and to return the PWM duty to the PWM duty $\gamma=\tau on/\tau$ specified by the PWM duty setting means 25*a* after a time point when the detected current Id decreases, approaches, and passes the target dither small current I1.

This applies to the second embodiment.

As described above, according to claim 9 of the present invention, the increased duty setting means or the decreased duty setting means for quickly increasing/quickly decreasing the dither current is provided.

Thus, direct negative feedback control for the dither large current and the dither small current is not carried out, but such a feature is provided that the energization duty is temporarily corrected upon an increase/decrease switching, resulting in an increase in response of the control.

Moreover, such a feature is provided that the increased duty setting means/the decreased duty setting means may quickly increase/decrease the energization current even when the energization of the proportional solenoid coil is started/stopped, to thereby cause the energization current to quickly approach the target current/to quickly shut off.

A commutation circuit connected in parallel with the proportional solenoid coil 105 includes a high-speed shutoff circuit configured to be enabled during a shutoff of the energization of the proportional solenoid coil 105 and in a decrease current required period upon a switching transition from the dither large current I2 to the dither small current I1.

The high-speed shutoff circuit includes: the attenuation resistor 155*a* connected in series to the commutation circuit device 152A; and an additional switching device 155*b* that is connected in parallel with the attenuation resistor 155*a* and is opened in the decrease current required period.

As described above, according to claim 13 of the present invention, during the shutoff of the energization of the proportional solenoid coil and during the decrease current required period upon the switching transition from the dither large current to the dither small current, the commutation current is quickly attenuated by the attenuation resistor serially connected to the commutation circuit device.

Thus, such a feature is provided that the fall time of the dither current is decreased to decrease a fluctuation error in the fall time, and, in the normal state in which the on/off control for the energization current is carried out, when the drive switching device is opened, the energization current commutes to the commutation circuit device, to thereby suppress release of the electromagnetic energy, resulting in control of the energization current by consuming a small electric power.

The PWM duty $\gamma$ of the pulse signal generated by the command pulse generation means 26*a* takes S/N when a clock signal is counted N times in the PWM cycle $\tau$, and S clock signals out of the N clock signals are on commands. The PWM cycle $\tau$ having the N clock signals as one unit is generated n times in the dither amplitude cycle Td. A minimum adjustment unit of the dither duty $\Gamma=B/Td$ is Td/n.

The command pulse generation means 26*a* is a ring counter 123*a* for counting the clock signal, and a concentrated type is used in which an on period is continuous so that the on period corresponds to count values from 1 to S and an off period corresponds to count values from S+1 to N.

This applies to the second embodiment.

As described above, according to claim 14 of the present invention, the PWM cycles are interposed in the one dither amplitude cycle period n times, the PWM duty $\gamma$2 corresponding to the dither large current I2 is set $B/\tau$ times out of the n times, and the PWM duty γ1 corresponding to the dither small current I1 is set A/τ times (A+B=n×τ).

Thus, such a feature is provided that occurrence of a control error generated between the target average current and the detected average current due to the variations in the current rise characteristic and the current fall characteristic of the proportional solenoid coil may be corrected by the dither duty Γ=B/(A+B).

Second Embodiment

(1) Detailed Description of Configuration

Figure 7:
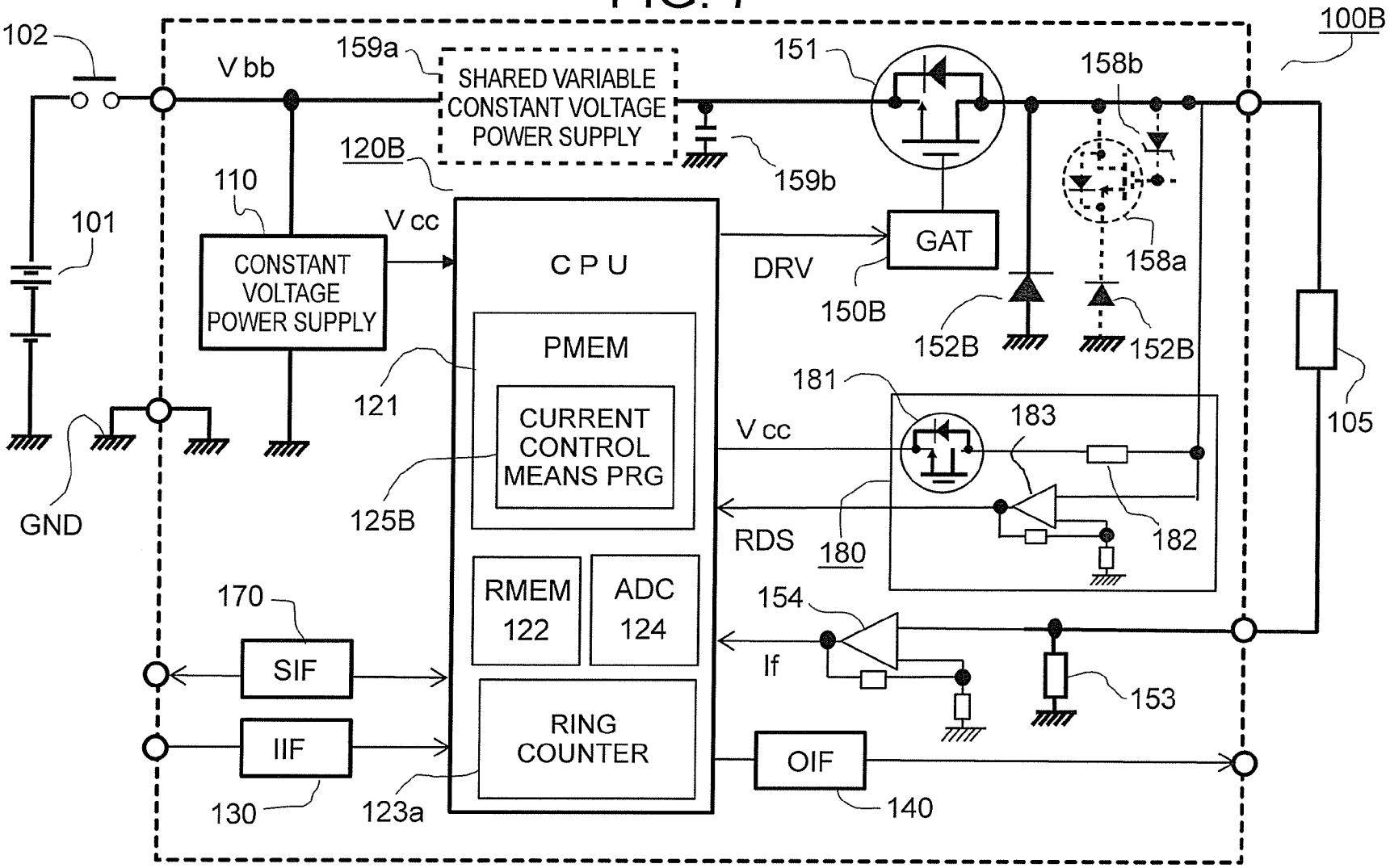
FIG. 7 is an overall circuit block diagram for illustrating a dither current power supply control apparatus according to a second embodiment of the present invention.

Referring to FIG. 7, which is an overall circuit block diagram for illustrating an apparatus according to the second embodiment of the present invention, a detailed description is now given of a configuration of the apparatus with a focus on a difference from the apparatus of FIG. 1.

Note that, in respective drawings, like reference numerals denote like or corresponding components, a capital alphabet added as a suffix to each reference numeral represents a difference between the embodiments.

As a main difference between FIG. 1 and FIG. 7, the commutation circuit device 152A, which is the field effect transistor, is changed to a commutation circuit device 152B, which is a diode, and a difference also exists in the high speed shutoff circuit. Further, in place of the temperature sensor 106, a resistance detection circuit 180 is used, and the label resistor 107 is not shown.

In FIG. 7, to a dither current power supply control circuit 100B, as in FIG. 1, the power supply voltage Vbb is applied from the external power supply 101, which is the in-vehicle battery, via the output contact 102 of the power supply relay, and the proportional solenoid coils 105 provided for the plurality of hydraulic solenoid valves in the vehicle transmission are connected.

The dither current power supply control apparatus 100B is mainly constructed by a calculation control circuit unit 120B including a microprocessor CPU. To the calculation control circuit unit 120B, the control voltage Vcc, which is the stabilized voltage of, for example, DC 5 V, is applied via the constant voltage power supply 110.

The calculation control circuit unit 120B is constructed by the nonvolatile program memory 121, the RAM memory 122 for calculation processing, the ring counter 123*a*, and the multi-channel AD converter 124. In the program memory 121, a control program serving as current control means 125B described later, and a nonvolatile data memory region for storing the correction parameter are provided.

As in FIG. 1, the input interface circuit 130, the output interface circuit 140, and the serial interface 170 are connected to the calculation control circuit unit 120B.

The drive switching device 151 connected at the upstream position of the proportional solenoid coil 105 is configured to be controlled to turn on/off via a gate circuit 150B by the drive pulse signal DRV generated by the calculation control circuit unit 120B.

The downstream position of the proportional solenoid coil 105 is connected to the ground circuit GND via the current detection circuit 153. The voltage between both ends of the current detection circuit 153 is amplified via the amplifier 154, and the current detection signal If at the voltage proportional to the energization current of the proportional solenoid coil 105 is input to the multi-channel AD converter 124.

The commutation circuit device 152B is connected between the connection point between the drive switching device 151 and the proportional solenoid coil 105 and the ground circuit GND, and is configured so that when the drive switching device 151 opens, the energization current flowing through the proportional solenoid coil 105 is commuted to flow through the current detection resistor 153.

Note that, the commutation circuit device 152B of this embodiment is a diode, and when the energization current needs to be quickly attenuated, it is desired to serially connect a commutation switching device 158*a* represented by the dotted lines, connect a voltage limiting diode 158*b* to the commutation switching device 158*a*, open the commutation switching device 158*a* in the decrease current required period, and limit a voltage between terminals of the commutation switching device 158*a* with the voltage limiting diode 158*b*.

Moreover, as in FIG. 1, it is desired to provide the shared variable constant voltage power supply 159*a* represented by the dotted lines and the smoothing capacitor 159*b* so that when the drive switching device 151 is completely conducted, a predetermined reference current is supplied even when the power supply voltage Vbb fluctuates or the internal resistance of the proportional solenoid coil 105 fluctuates due to a change in an environmental temperature.

The resistance detection circuit 180 is constructed by a second amplifier 183 for supplying a pulse current from the control voltage Vcc to the proportional solenoid coil 105 in a non-driving state via a sampling switching device 181 and a series resistor 182 having a resistance Rs larger than the load resistance R, and amplifying an application voltage Vs=Vcc×R/(R+Rs) for the proportional solenoid coil 105 on this occasion, to thereby generate a resistance detection signal RDS.

Note that, the resistance Rs is sufficiently larger than the load resistance R, a relationship of the application voltage Vs≈−Vcc×R/Rs is established, and a current Vcc/Rs flowing to the proportional solenoid coil 105 via the series resistor 182 is minute, and, as a result, the hydraulic solenoid valve is not activated.

Figure 8:
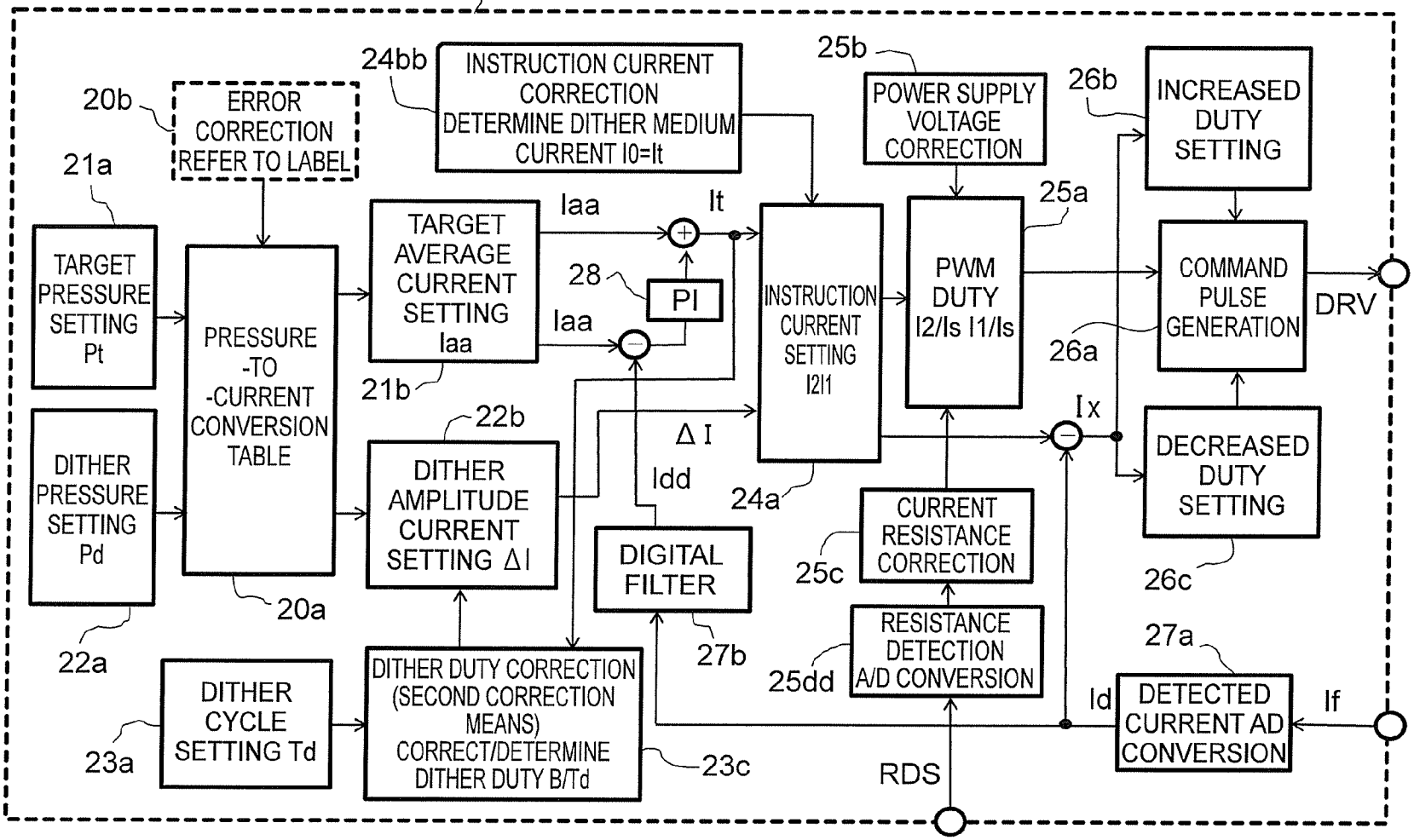
FIG. 8 is a diagram for illustrating a current control block by a calculation control circuit unit of FIG. 7.

Then, referring to FIG. 8, which is a diagram for illustrating a current control block by the calculation control circuit unit 120B of FIG. 7, a detailed description is given of a configuration of the unit with a focus on a difference from the unit of FIG. 2.

First, the difference between FIG. 2 and FIG. 8 includes dither duty correction means 23*c* (second correction means), instruction current correction means 24*bb*, and resistance signal input means 25*dd*, and the error correction means 20*b* is omitted, but all the other components are the same as those of the unit of FIG. 2.

In FIG. 8, the dither duty correction means 23*c* is configured to set, based on the combined target current It, the dither duty Γ=B/Td for the dither current large period B and the dither current small period A described later with reference to FIG. 9A and FIG. 9B. According to this embodiment, the dither duty Γ=B/Td is set based on (Expression 5b).

(Expression 5b) is stored in the data memory region of the program memory 121 as the correction parameter.

The instruction current correction means 24*bb* is configured to directly apply the combined target current It without correction as the dither medium current I0 applied by the instruction current setting means 24*a*.

The resistance signal input means 25*dd* is configured to apply pulse drive to the sampling switching device 181 and to receive the resistance detection signal RDS on this occasion, to thereby calculate the load resistance R, which is an internal resistance of the proportional solenoid coil 105 at the current temperature, by using an expression $R=Rs\times Vs/(Vcc-Vs)\approx Rs\times Vs/Vcc$.

(2) Detailed Description of Actions/Operations and Method

Figure 10:
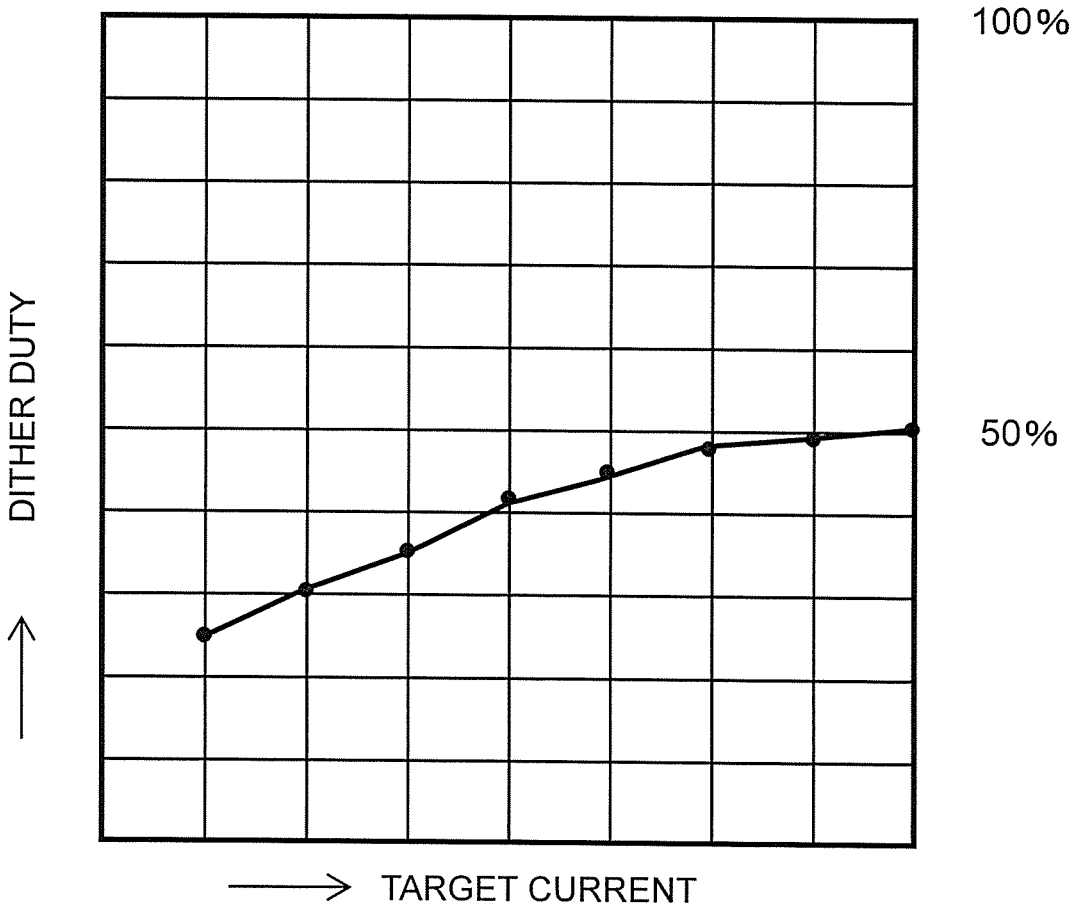
FIG. 10 is a correction characteristic diagram for showing a relationship between a dither duty and a target current in the case of FIG. 7.

A detailed description is now sequentially given of actions/operations and a control method for the apparatus constructed as in FIG. 7 and FIG. 8 according to the second embodiment of the present invention with reference to characteristic diagrams shown in FIG. 9A, FIG. 9B, and FIG. 10.

First, in FIG. 7 and FIG. 8, when the power supply switch (not shown) is closed, the output contact 102 of the power supply relay closes, and the power supply voltage Vbb is applied to the dither current power supply control apparatus 100B. As a result, the constant voltage power supply 110 generates the control voltage Vcc, which is a stabilized voltage of, for example, DC 5 V, and the microprocessor CPU constructing the calculation control circuit unit 120B starts a control operation.

The microprocessor CPU operates in response to operation states of the input sensor group (not shown) input from the input interface circuit 130 and contents of the control programs stored in the nonvolatile program memory 121, generates load drive command signals directed to the electric load group (not shown) connected to the output interface circuit 140, and carries out, via the drive switching device 151, on/off control for each of the plurality of proportional solenoid coils 105, which are specific electric loads among the electric load group, to control the energization current therefor.

The drive switching device 151 is controlled to turn on/off by the drive pulse signal DRV generated by the command pulse generation means 26*a* illustrated in FIG. 8. The drive pulse signal DRV generates the on command only for the on period $\tau on$ in the PWM cycle $\tau$, and, as a result, an average voltage of $Vbb\times\tau on/\tau$ is applied to the proportional solenoid coil 105.

The instruction current setting means 24*a* cooperates with the dither amplitude current setting means 22*b* and the instruction current correction means 24*bb* to determine the dither medium current I0 corresponding to the combined target current It to calculate the dither large current I2 and the dither small current I1 represented as Expression 1, and instructs the PWM duty $\gamma=\tau on/\tau$ directed to the command pulse generation means 26*a* via the PWM duty setting means 25*a*.

The instruction current correction means 24*bb* is configured to directly apply the combined target current It without correction as the dither medium current I0 applied by the instruction current setting means 24*a* as described above.

The combined target current It is an algebraic sum of the target average current Iaa set by the target average current setting means 21*b* and the error signal generated by the proportional/integral means 28. To the proportional/integral means 28, a deviation signal between the target average current Iaa set by the target average current setting means 21*b* and the detected average current Idd calculated by the digital filter 27*b* is input.

The smoothing time constant Tf of the digital filter 27*b* is more than the dither amplitude cycle Td. The detected average current Idd corresponds to the waveform average current Ia of the pulsating dither current.

In contrast, the detected current Id acquired by simple digital conversion of the current detected signal If acquired from the amplifier 154 represents a current value of the energization current pulsating depending on the large and small dither currents.

The increased duty setting means 26*b* and the decreased duty setting means 26*c* are configured to assist the command pulse generation means 26*a* in quickly increasing/quickly decreasing the PWM duty $\gamma$ in response to the deviation current Ix between the dither large current I2 and the dither small current I1 alternately generated as command signals by the instruction current setting means 24*a* and the detected current Id, to thereby attain a quick current change.

Thus, the frequently increasing/decreasing dither amplitude current is not directly subject to the negative feedback control by the calculation control means, and an indirect reflection is realized by negative feedback control of the waveform average current of the dither amplitude current, and hence a response to the energization current frequently changing in a predetermined increase/decrease pattern is not necessary. Therefore, a control characteristic is stabilized, and simple calculation control means may be applied.

Next, in FIG. 9A and FIG. 9B, which are characteristic diagrams for showing the current waveforms by the current control block of FIG. 8, FIG. 9A is a diagram for showing a current waveform when the commutation circuit device 152B is the diode illustrated in FIG. 7 and does not include the commutation switching device 158*a* and the voltage limiting diode 158*b* which are represented by the dotted lines, and particularly the dither current large period B is set to be shorter than the dither current small period A.

As apparent from FIG. 9A, the rise time from the dither small current I1 to the dither large current I2 is shorter than the fall time from the dither large current I2 to the dither small current I1, and, as a result, the waveform average current Ia is a smaller value than the dither medium current I0.

In contrast, FIG. 9B is a diagram for showing the current waveform when the dither current large period B and the dither current small period A are set to be equal to each other.

As a result, in FIG. 9A, the waveform average current Ia is less than the dither medium current I0, and, in FIG. 9B, the waveform average current Ia is more than the dither medium current I0.

Note that, the relationship between the waveform average current Ia and the dither medium current I0 is as described above referring to FIG. 4.

Moreover, the reference examples of the average response time difference ((a−b)) and the instruction current (dither medium current I0)) are as shown in FIG. 5.

FIG. 10, which is a correction characteristic diagram for showing a relationship between the dither duty and the target current of the apparatus of FIG. 7, is a diagram for showing the relationship of the dither duty $\Gamma=B/Td$ so that the combined target current It and the dither medium current I0 match each other by the second correction method, which is calculated based on (Expression 5b).

(3) Gist and Features of Second Embodiment

As apparent from the above description, the dither current power supply control method according to the second embodiment of the present invention, as in the case of the first embodiment, is configured to determine the dither medium current serving as the instruction current so that the waveform average current of the energization current to the inductive electric load matches the target average current, and an operation is performed with the instruction current in which the fluctuation errors in the rise time and the fall time that fluctuate depending on the magnitudes of the dither medium current and the dither amplitude current are corrected on the actual operation stage with use of the correction parameter measured on the preliminary experimental stage.

Moreover, according to claim 2 of the present invention, on the experimental measurement stage, the dither duty is adjusted so that the set dither medium current and the detected average current match each other, and the response time difference, which is the difference between the fall time and the rise time corresponding to the dither medium current, is measured.

On the actual operation stage, a second correction method is applied.

The second correction method involves setting B−b=A−a in (Expression 2) so that the waveform average current Ia serving as the target average current Iaa and the dither medium current I0 serving as the instruction current match each other, and, in correspondence to the dither medium current I0, the dither current large period B or the dither current small period A is calculated by (Expression 5b) or (Expression 5a).

$$A=[(Td+((a-b))]/2 \quad \text{(Expression 5a)}$$

$$B=[(Td-((a-b))]/2 \quad \text{(Expression 5b).}$$

As the average response time difference ((a−b)), an average response time difference corresponding to a medium value between a minimum value and a maximum value of a practical range of the target average current Iaa or corresponding to a specific representative target average current frequently used is applied, or an average response time difference calculated by interpolation by using a plurality of average response time differences relating to the target average current Iaa on the plurality of stages is applied.

As described above, according to claim 3 of the present invention, on the experimental measurement stage, the dither duty is adjusted so that the waveform average current and the dither medium current match each other, and the response time difference, which is the difference between the fall time and the rise time corresponding to the dither medium current, is measured. Further, as the second correction method on the actual operation stage, the dither duty is made variable also on the actual operation stage, and the dither current large period and the dither current small period are calculated by using the response time difference data acquired on the experimental measurement stage.

Thus, such a feature is provided that a simple expression represented as (Expression 5b) is used to correct the dither duty without correcting the dither medium current, and hence even when the fall time and the rise time of the dither current fluctuate, an appropriate dither medium current is determined as the instruction current in correspondence to the given target average current, thereby reducing the control error.

As apparent from the above description, the dither current power supply control apparatus 100B according to the second embodiment of the present invention includes, as in the first embodiment, the calculation control circuit unit 120B including the current control means 125B, the drive switching device 151 for the proportional solenoid coil 105, and the commutation circuit device 152B. The dither current power supply control apparatus 100B further includes the instruction current setting means 24*a* and the dither duty correction means 23*c* in order to acquire the target average current Iaa and the dither amplitude current ΔI given by the target average current setting means 21*b* and the dither amplitude current setting means 22*b*, and is configured to set the dither medium current I0 or the dither duty Γ so as to establish such a relationship that the detected average current Idd of the proportional solenoid coil 105 is equal to the target average current Iaa.

Further, in place of the first correction means 24*b* according to the first embodiment, the second correction means 23*c* is applied, and the second correction means 23*c* serves as the dither duty correction means for acting on the dither current amplitude setting means 22*b* to set the dither duty Γ=B/Td, which is the ratio of the dither current large period B to the dither amplitude cycle Td, to establish such a relationship that the target average current Iaa and the dither medium current I0 match each other.

The proportional solenoid coil 105 is provided for each of a plurality of hydraulic solenoid valves for selecting a shift position of a vehicle transmission. Each of a plurality of the proportional solenoid coils 105 includes the drive switching device 151, and includes a resistance detection circuit 180 connected to at least a pair of the proportional solenoid coils 105 configured such that, when one proportional solenoid coil is supplied with power, another proportional solenoid coil is not supplied with power.

The resistance detection circuit 180 is configured to supply a pulse current from a stabilized control voltage Vcc to the proportional solenoid coil 105 in a non-driving state via the sampling switching device 181 and the series resistor 182 having a resistance value Rs larger than the load resistance R, and includes the second amplifier 183 for amplifying an applied voltage Vs=Vcc×R/(R+Rs) to the proportional solenoid coil 105 during the supply of the pulse current, to thereby generate a resistance detection signal RDS.

The calculation control circuit unit 120B is configured to pulse-drive the sampling switching device 181, and receive the resistance detection signal RDS during the pulse-drive, to thereby calculate the load resistance R, which is an internal resistance of the proportional solenoid coil 105 at a current temperature, by using an expression R=Rs×Vs/(Vcc−Vs)Rs×Vs/Vcc.

The proportional solenoid coil 105 is supplied with power via a shared variable constant voltage power supply having an output voltage corrected by a value of the load resistance R, or includes the PWM duty setting means 25*a* for correcting the energization duty of the drive switching device 151 based on the value of the load resistance R.

As described above, according to claim 12 of the present invention, the calculation control circuit unit is configured to monitor the voltage between both ends of the proportional solenoid coil acquired by driving the proportional solenoid coil in the non-driving state via a series resistor large in the resistance in a short period, to thereby measure the load resistance of the proportional solenoid coil.

Thus, such a feature is provided that the proportional solenoid coil does not malfunction by the minute pulse current in the short period, and a measurement time constant, which is a ratio between the inductance L of the proportional solenoid coil and the resistance Rs of the series resistor, is small, and hence a saturation voltage for the proportional solenoid coil may be measured by using the pulse current in the short period.

Note that, the temperature of the proportional solenoid coil is further increased by self-heat generation during the energization drive, and hence the determination result needs to reflect this state. This holds true for a case where an oil temperature sensor is provided. However, such a feature is provided that, at least at an environmental temperature fluctuating from an extremely low temperature to an extremely high temperature, the current resistance may be approximately correctly measured, and the number of signal lines may be reduced compared with the case where the oil temperature sensor is used.

This applies to the third embodiment.

A commutation circuit connected in parallel with the proportional solenoid coil 105 includes a high-speed shutoff circuit configured to be enabled during a shutoff of the energization of the proportional solenoid coil 105 and in a decrease current required period upon a switching transition from the dither large current I2 to the dither small current I1.

The high-speed shutoff circuit is the commutation switching device 158*a* connected in series to the commutation circuit device 152B.

The voltage limiting diode 158*b* is connected to the commutation switching device 158*a*, and the commutation switching device 158*a* is opened in the decrease current required period so that a voltage between both ends of the commutation switching device 158*a* is limited by the voltage limiting diode 158*b*.

As described above, according to claim 13 of the present invention, during the shutoff of the energization of the proportional solenoid coil and during the decrease current required period upon the switching transition from the dither large current to the dither small current, the commutation current is quickly attenuated by the commutation switching device serially connected to the commutation circuit device.

Thus, such a feature is provided that the fall time of the dither current is decreased to decrease a fluctuation error in the fall time, and, in the normal state in which the on/off control for the energization current is carried out, when the drive switching device is opened, the energization current commutes to the commutation circuit device, to thereby suppress release of the electromagnetic energy, resulting in control of the energization current while a small electric power is consumed.

Third Embodiment

(1) Detailed Description of Configuration

Figure 11:
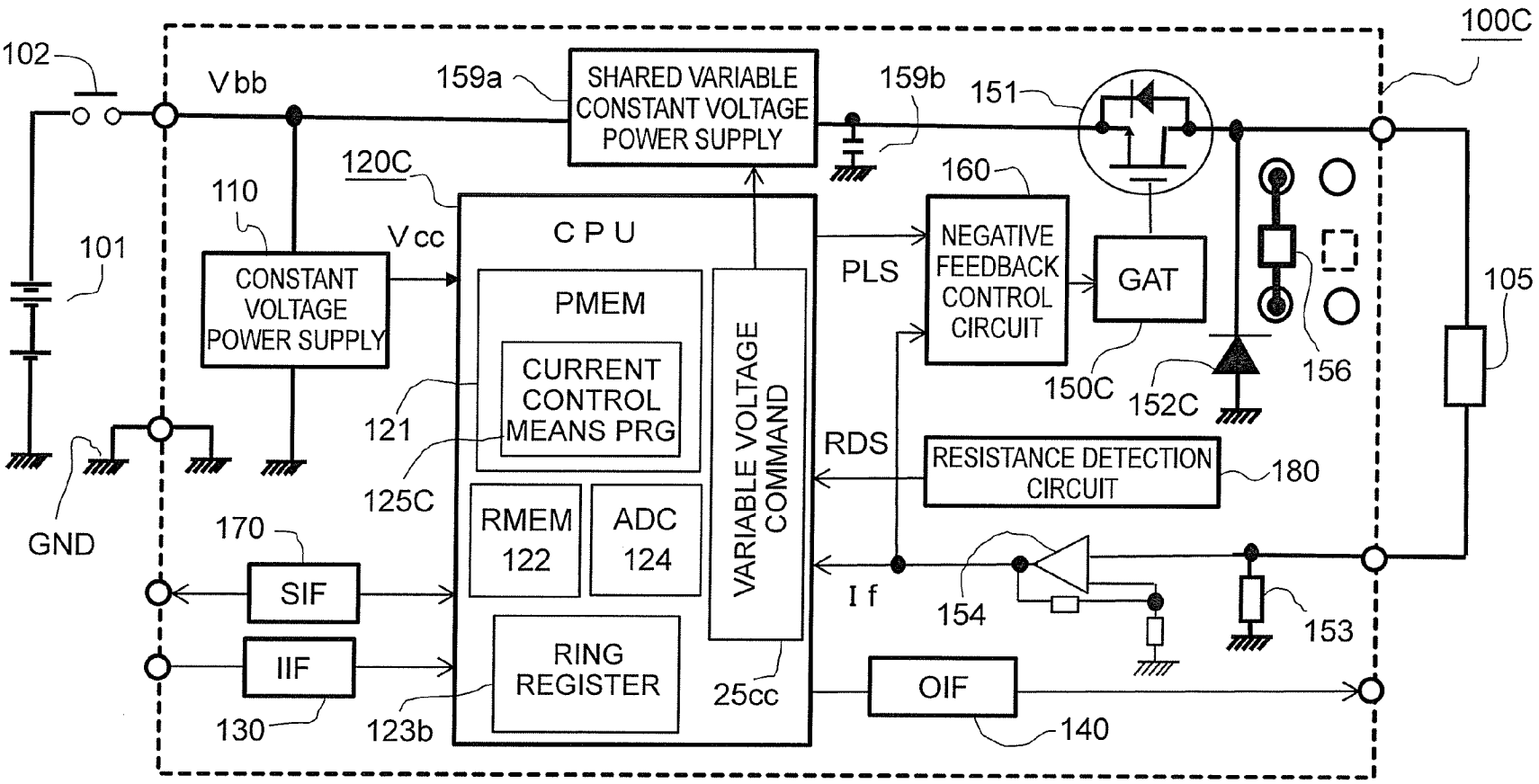
FIG. 11 is an overall circuit block diagram for illustrating a dither current power supply control apparatus according to a third embodiment of the present invention.

Referring to FIG. 11, which is an overall circuit block diagram for illustrating an apparatus according to the third embodiment of the present invention, a detailed description is now given of a configuration of the apparatus with a focus on a difference from the apparatus of FIG. 1.

Note that, in respective drawings, like reference numerals denote like or corresponding components, and a capital alphabet added as a suffix to each reference numeral represents a difference between the embodiments.

First, as a fundamental difference between FIG. 1 and FIG. 11, in FIG. 11, a negative feedback control circuit 160 is provided between a calculation control circuit unit 120C and a gate circuit 150C, and the negative feedback circuit 160 is configured to smooth the command pulse signal PLS generated by the calculation control circuit unit 120C, and apply switching control to the drive switching device 151 so that the energization current is proportional to the smoothed voltage.

Moreover, as a main difference between FIG. 1 and FIG. 11, the commutation circuit device 152A, which is the field effect transistor, is changed to a commutation circuit device 152C, which is a diode, and the high speed shutoff circuit is omitted.

Note that, in order to identify the configuration of the commutation circuit, a jumper 156 is connected to a circuit board (not shown).

Further, in place of the temperature sensor 106, a resistance detection circuit 180 is used, the label resistor 107 is not shown, and a ring register 123*b* is provided in place of the ring counter 123*a*.

In FIG. 11, to a dither current power supply control circuit 100C, as in FIG. 1, the power supply voltage Vbb is applied from the external power supply 101, which is the in-vehicle battery, via the output contact 102 of the power supply relay, and the proportional solenoid coils 105 provided for the plurality of hydraulic solenoid valves in the vehicle transmission are connected.

The dither current power supply control apparatus 100C is mainly constructed by a calculation control circuit unit 120C including a microprocessor CPU. To the calculation control circuit unit 120C, the control voltage Vcc, which is the stabilized voltage of, for example, DC 5 V, is applied via the constant voltage power supply 110.

The calculation control circuit unit 120C is constructed by the nonvolatile program memory 121, the RAM memory 122 for calculation processing, the ring register 123*b*, and the multi-channel AD converter 124. In the program memory 121, a control program serving as current control means 125C described later, a control program serving as variable voltage command means 25*cc*, and a nonvolatile data memory region for storing the correction parameter are provided.

As in FIG. 1, the input interface circuit 130, the output interface circuit 140, the serial interface 170 are connected to the calculation control circuit unit 120C.

The drive switching device 151 connected at the upstream position of the proportional solenoid coil 105 is configured to be controlled to turn on/off via the gate circuit 150C by the energization command signal generated by the negative feedback control circuit 160.

The downstream position of the proportional solenoid coil 105 is connected to the ground circuit GND via the current detection circuit 153. The voltage between both ends of the current detection circuit 153 is amplified via the amplifier 154, and the current detection signal If at the voltage proportional to the energization current of the proportional solenoid coil 105 is input to the multi-channel AD converter 124.

The commutation circuit device 152C is connected between the connection point between the drive switching device 151 and the proportional solenoid coil 105 and the ground circuit GND, and is configured so that when the drive switching device 151 opens, the energization current flowing through the proportional solenoid coil 105 is commuted to flow through the current detection resistor 153.

Note that, according to this embodiment, such a state that the commutation circuit device 152C is the diode can be identified by the jumper 156.

As a desired form, the shared variable constant voltage power supply 159*a* and the smoothing capacitor 159*b* are connected to an upstream position of the drive switching device 151 so that when the drive switching device 151 is completely conducted, a predetermined reference current is supplied even when the power supply voltage Vbb fluctuates or the internal resistance of the proportional solenoid coil 105 fluctuates due to a change in the environmental temperature.

As described above with reference to FIG. 7, the resistance detection circuit 180 is constructed by the second amplifier 183 for supplying the pulse current from the control voltage Vcc to the proportional solenoid valve 105 in the non-driving state via the sampling switching device 181 and the series resistor 182 having the resistance Rs larger than the load resistance R, and amplifying the voltage Vs=Vcc×R/(R+Rs) applied to the proportional solenoid coil 105 on this occasion, to thereby generate the resistance detection signal RDS.

Note that, the resistance Rs is sufficiently larger than the load resistance R, the relationship of the application voltage Vs-Vcc×R/Rs established, and the current Vcc/Rs flowing to the proportional solenoid coil 105 via the series resistor 182 is minute, and, as a result, the hydraulic solenoid valve is not activated.

Then, the shared variable constant voltage power supply 159*a* is configured so that the output voltage is corrected by the variable voltage command means 25*cc* operating in response to the resistance detection signal RDS.

Figure 12:
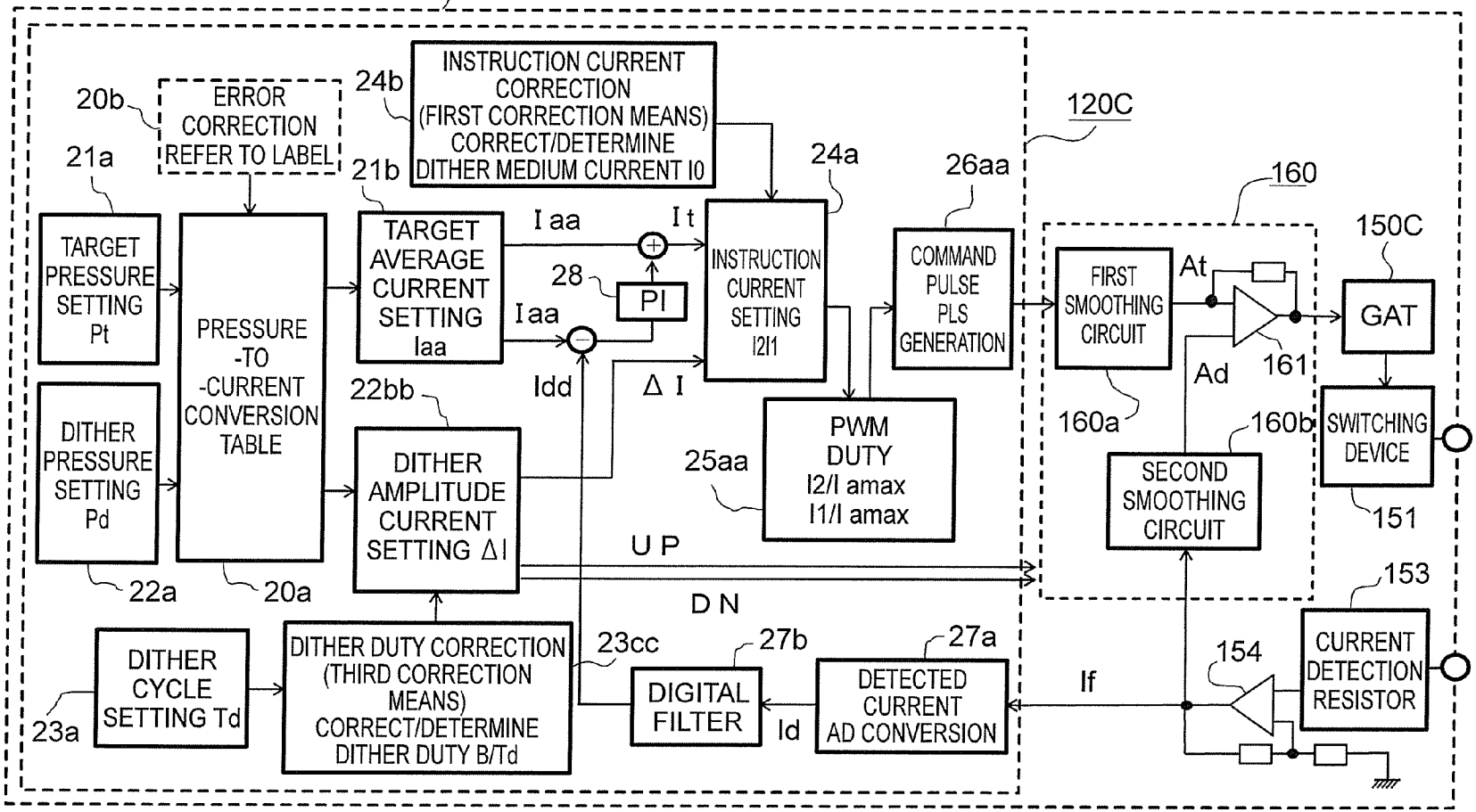
FIG. 12 is a diagram for illustrating a current control block by a calculation control circuit unit of FIG. 11.

Then, referring to FIG. 12, which is a diagram for illustrating a current control block by the calculation control circuit unit 120C of FIG. 11, a detailed description is given of a configuration of the unit with a focus on a difference from the unit of FIG. 2.

First, the difference between FIG. 2 and FIG. 12 includes dither amplitude current setting means 22*bb*, dither duty correction means 23*cc* (third correction means), PWM duty setting means 25*aa*, and command pulse generation means 26*aa*. The current voltage correction means 25*b*, the current resistance correction means 25*c*, and the detected temperature input means 25*d* are not provided, and the error correction means 20*b* is omitted, but all the other components are the same as those of the unit of FIG. 2.

In FIG. 12, the dither amplitude current setting means 22*bb* is configured to generate an increase start command pulse UP and a decrease start command pulse DN directed to the negative feedback control circuit 160. The increase start command pulse UP is configured to generate a first pulse signal having a predetermined temporal width or a variable temporal width upon the start of the energization of the proportional solenoid coil 105 or the switching by the dither amplitude current setting means 22*bb* from the dither small current I1 to the dither large current I2. The decrease start command pulse DN is configured to generate a second pulse signal having a predetermined temporal width or a variable temporal width upon the stop of the energization of the proportional solenoid coil 105 or the switching by the dither amplitude current setting means 22*bb* from the dither large current I2 to the dither small current I1. The negative feedback control circuit 160 is configured to operate in response to the first pulse signal or the second pulse signal, to thereby temporally quickly increase or quickly decrease an analog command signal At input to the comparison control circuit 161.

The dither duty correction means 23*cc* serves as third correction means for using the correction parameter stored in the program memory 121 to correct the dither duty Γ, to thereby apply the common instruction current correction means 24*b* (first correction means) to products having different forms of the commutation circuit. A detailed description is later given of the dither duty correction means 23*cc*.

The PWM duty setting means 25*aa* is configured to determine a PWM duty γ=τon/τ of the command pulse signal PLS generated by the command pulse generation means 26*aa*. A close period τon of the PWM duty γ=τon/τ, which is an on period, is determined so that γ2=I2/Iamax or γ1=I1/Iamax, which is a ratio of the dither large current I2 or the dither small current I1 that is an instruction current by the instruction current setting means 24*a*, to a maximum value Iamax of the target average current Iaa is established.

The PWM duty γ of the pulse signal generated by the command pulse generation means 26*aa* takes S/N when a clock signal is counted N times in the PWM cycle τ, and S clock signals out of the N clock signals are on commands. The PWM cycle τ having the N clock signals as one unit is generated n times in the dither amplitude cycle Td. A minimum adjustment unit of the dither duty Γ=B/Td is Td/n.

To the command pulse generation means 26*aa*, second means is applied, which is constructed by the ring register 123*b* in which S on-timings are distributed in N clock signals.

The negative feedback control circuit 160 uses the comparison control circuit 161 to compare the analog command signal At acquired by using the first smoothing circuit 160*a* to smooth the command pulse signal PLS and a current detected signal Ad acquired by using the second smoothing circuit 160*b* to smooth the output voltage of the amplifier 154 with each other, and, independently of presence or absence of the fluctuation in the power supply voltage Vbb and presence or absence of the fluctuation in the load resistance R, in correspondence to the dither large current I2 and the dither small current I1, switches the drive switching device 151 so as to establish such a relationship that the energization current matches, to thereby carry out negative feedback control. Further, smoothing time constants of the first and second smoothing circuits 160*a* and 160*b* are more than the PWM cycle τ and less than the inductive time constant Tx of the proportional solenoid coil 105.

(2) Detailed Description of Actions/Operations and Method

Figure 13:
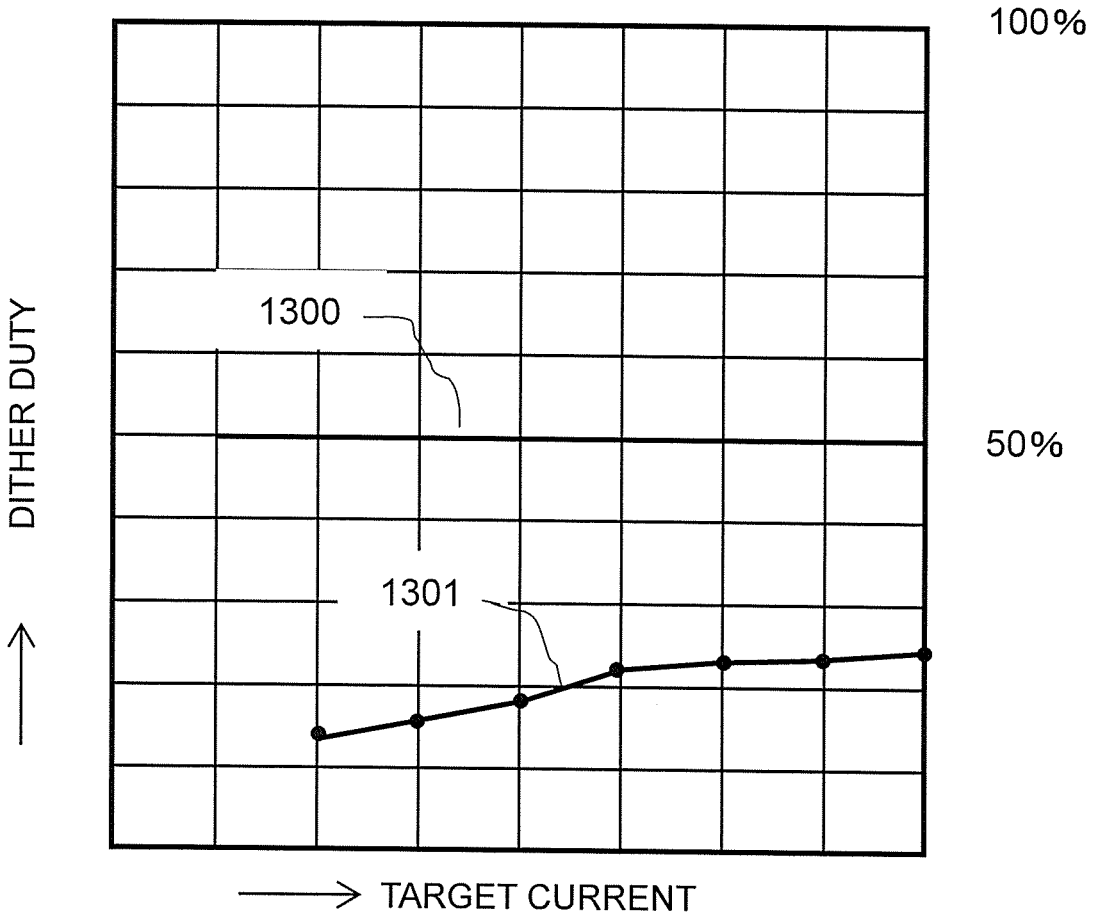
FIG. 13 is an experiment characteristic diagram for showing a relationship between a dither duty and a target current in the case of FIG. 11.

A detailed description is now sequentially given of actions/operations and a control method for the apparatus constructed as in FIG. 11 and FIG. 12 according to the third embodiment of the present invention with reference to a characteristic diagram shown in FIG. 13 and a data map shown in FIG. 14.

First, in FIG. 11 and FIG. 12, when the power supply switch (not shown) is closed, the output contact 102 of the power supply relay closes, and the power supply voltage Vbb is applied to the dither current power supply control apparatus 100C.

As a result, the constant voltage power supply 110 generates the control voltage Vcc, which is a stabilized voltage of, for example, DC 5 V, and the microprocessor CPU constructing the calculation control circuit unit 120C starts a control operation.

The microprocessor CPU operates in response to operation states of the input sensor group (not shown) input from the input interface circuit 130 and contents of the control programs stored in the nonvolatile program memory 121, generates load drive command signals directed to the electric load group (not shown) connected to the output interface circuit 140, and carries out, via the drive switching device 151, on/off control for each of the plurality of proportional solenoid coils 105, which are specific electric loads among the electric load group, to control the energization current therefor.

The drive switching device 151 uses the first smoothing circuit 160*a* in the negative feedback control circuit 160 to once smooth the command pulse signal PLS generated by the command pulse generation means 26*aa* illustrated in FIG. 12, converts the command pulse signal PLS into the analog command signal At, is again controlled to turn on/off, and is thus controlled by the negative feedback so as to establish such a relationship that the current detection signal Ad acquired from the second smoothing circuit 160*b* and the analog command signal At match each other.

The instruction current setting means 24*a* cooperates with the dither amplitude current setting means 22*bb* and the instruction current correction means 24*b* to determine the dither medium current I0 corresponding to the combined target current It to calculate the dither large current I2 and the dither small current I1 represented as Expression 1, and instructs the PWM duty $\gamma=\tau on/\tau$ directed to the command pulse generation means 26*aa* via the PWM duty setting means 25*aa*.

The instruction current correction means 24*b* is configured to calculate, based on the correction parameter described above, the dither medium current I0 serving as the instruction current corresponding to the combined target current It.

The combined target current It is an algebraic sum of the target average current Iaa set by the target average current setting means 21*b* and the error signal generated by the proportional/integral means 28. To the proportional/integral means 28, a deviation signal between the target average current Iaa set by the target average current setting means 21*b* and the detected average current Idd calculated by the digital filter 27*b* is input.

The smoothing time constant Tf of the digital filter 27*b* is more than the dither amplitude cycle Td. The detected average current Idd corresponds to the waveform average current Ia of the pulsating dither current.

In FIG. 12, the dither duty correction means 23*cc* corresponds to the third correction method, and is configured to set, in order to apply the common dither medium current I0 described in (Expression 2aa) to a first product (in the case of the commutation circuit device 152C according to the third embodiment) having a response time difference (a1−b1) and a second product (in the case of the commutation circuit device 152A according to the first embodiment) having a response time difference (a2−b2), where (a2−b2) >(a1−b1), a dither duty Γ2=B2/Td of the second product to be smaller than a dither duly Γ1=B1/Td=0.5 of the first product.

$$Iaa=Ia=I0+0.5\times\Delta I\times((a1-b1)) \quad \text{(Expression 2aa)}$$

In other words, in order to equalize the value of (Expression 2) relating to the first product and the value of (Expression 2) relating to the second product to each other, a relationship of (Expression 6) is necessary.

$$(B1-b1)-(A1-a1)=(B2-b2)-(A2-a2) \quad \text{(Expression 6)}$$

On this occasion, by providing relationships of A1=B1=Td/2 and A2+B2=Td, (Expression 6a) and (Expression 6b) are acquired.

$$A2=[Td+(a2-b2)-(a1-b1)]/2 \quad \text{(Expression 6a)}$$

$$B2=[Td-(a2-b2)+(a1-b1)]/2 \quad \text{(Expression 6b)}$$

Thus, the dither duty Γ2=B2/Td of the second product is determined while using a difference value (a2−b2)−(a1−b1) between the response time differences as a correction parameter.

As an average response time difference ((a1−b1)), which is an average of the plurality of samples, and an average difference value ((a2−b2)−(a1−b1)) of the average response time difference, an average response time difference corresponding to a medium value between the minimum value and the maximum value of a practical range of the target average current Iaa or corresponding to a specific representative target average current frequently used is applied, or an average response time difference calculated by interpolation while using a plurality of average response time differences relating to the target average current Iaa on the plurality of stages is applied.

In FIG. 13, which is an experiment characteristic diagram for showing a relationship between the dither duty and the target current of the dither current power supply control apparatus of FIG. 11, a characteristic diagram 1300 represents the dither duty Γ1=B1/Td=50% of the first product, and a characteristic diagram 1301 represents the dither duty Γ2=B2/Td of the second product based on (Expression 6b).

In FIG. 14, which is a data map for showing bit patterns of the ring register 123*b* of FIG. 11, a ring register having a 24-bit length at a center on a top row is shown as an example, and various bit patterns different in the number of ONs, which is the number of logical "1"s, among the total bit number N=24, are shown.

For example, when the number S of ONs is six (S=6), as shown on a sixth row of FIG. 14, six logical "1"s are evenly distributed by repeating a sequence including one logical "1" followed by three logical "0"s for six times.

However, when the number S of ONs is seven (S=7), as shown on a seventh row of FIG. 14, the distribution of "1"s and the distribution of "0"s are evenly distributed by alternating a sequence of one logical "1" followed by two logical "0"s and a sequence of one logical "1" followed by three logical "0"s.

Note that, in the data map of FIG. 14, when the number S of the logical "1"s is more than 12, (N−S) logical "0"s are evenly distributed, and for example, an inversion in the logic of a distribution on an 11th row matches a distribution on a 13th row.

Those bit patterns generated as follows are stored in the data memory region of the program memory 121, and to be read and transferred.

First, when the energization duty is equal to or less than 50% and a value N/S=γ is an integer, an ON/OFF pattern for generating the ON command once and then the OFF command (γ−1) times, and again generating the ON command once and then the OFF command (γ−1) times is repeated.

For example, when N=24 and S=6, γ=N/S=4. Thus, an ON/OFF pattern for generating the ON command once and then the OFF command (γ−1)=3 times, and again generating the ON command once and then the OFF command 3 times only needs to be repeated.

When the energization duty is equal to or less than 50%, a quotient of N/S is γ, and a remainder is δ, the ON/OFF pattern for generating the ON command once and then the OFF command (γ−1) times or the OFF command γ times, and again generating the ON command once and then the OFF command (γ−1) times or the OFF command γ times is repeated, and the γ times of the OFF command are generated δ times in the S times of the repetitions.

For example, when N=24 and S=7, the quotient γ=24/7=3, and the remainder δ=3. Thus, the ON/OFF pattern for generating the ON command once and then the OFF command twice or the OFF command three times, and again generating the ON command once and then the OFF command twice or the OFF command three times only needs to be repeated, and the three times of the OFF command only needs to be generated three times in 7 times of the repetitions.

When the energization duty γ is more than 50%, based on a complement pattern in which the ON and OFF of the ON/OFF pattern when the energization duty is equal to or less than 50% are inverted, S times of the OFF command out of N times may be generated to attain the energization duty (N−S)/N.

The ring registers 123 are provided independently for setting the dither current large period B and setting the dither current small period A. When the set values are changed, the setting is changed for the dither current small period A during the dither current large period B, and the setting is changed for the dither current large period B during the dither current small period A.

Note that, the data stored in the ring register is circulated by the clock signal, and an output of a flag bit at an end position serves as a command signal PLS. Moreover, in order to set the ON/OFF duty in unit of 1%, the length of each of the ring registers needs to be equal to or more than 100 bits.

In the above description, the partially different various modified elements are applied in correspondence to the first to third embodiments, but those elements are applicable to any of the embodiments.

For example, the four types of the configurations of the commutation circuit including the commutation circuit device 152A (field effect transistor) of FIG. 1, the commutation circuit acquired by providing the attenuation resistor 155*a* and the additional switching device 155*b* for the commutation circuit device 152A, the commutation circuit device 152B (diode) of FIG. 7, and the commutation circuit acquired by providing the commutation switching device 158*a* and the voltage limiting diode 158*b* for the commutation circuit device 152B are described, but the configuration of the commutation circuit is identified based on the connection states of the two jumpers 156 illustrated in FIG. 11, or the model code stored in the program memory 121.

Moreover, in order to detect the current resistance of the proportional solenoid coil 105, any one of the temperature sensor 106 of FIG. 1 and the resistance detection circuit 180 of FIG. 7 or FIG. 11 only needs to be used.

Moreover, as the resistance detection circuit, the voltage applied by the drive switching device 151 to the proportional solenoid coil 105 under the energization control and the current detected by the current detection resistor 153 may be used for the calculation.

In the above description, as the command pulse generation means 26*a* and 26*aa*, the case of the simple ring counter 123*a* and the case of the ring register 123*b* excellent in the smoothing characteristic are described, and any one of the cases may be applied to each of the embodiments.

In the above description, the shared variable constant voltage power supply 159*a* is described as a step-down type from the external power supply 101. However, when the external power supply 101 is an in-vehicle battery, the shared variable constant voltage power supply 159*a* may incorporate a boost circuit to increase performance to supply the electric power to the proportional solenoid coils in a case of an abnormal decrease in the power supply voltage and in a high temperature/high resistance state, and to reduce a nominal current of the proportional solenoid coils 105, to thereby suppress the power consumption of the drive switching devices 151.

(3) Gist and Features of Third Embodiment

As apparent from the above description, the dither current power supply control method according to the third embodiment of the present invention, as in the case of the first embodiment, is configured to determine the dither medium current serving as the instruction current so that the waveform average current of the energization current to the inductive electric load matches the target average current, and an operation is performed with the instruction current in which the fluctuation errors in the rise time and the fall time that fluctuate depending on the magnitudes of the dither medium current and the dither amplitude current are corrected on the actual operation stage with use of the correction parameter measured on the preliminary experimental stage.

Moreover, according to claim 2 of the present invention, on the experimental measurement stage, the dither duty is adjusted so that the set dither medium current and the detected average current match each other, and the response time difference, which is the difference between the fall time and the rise time corresponding to the dither medium current, is measured.

On the actual operation stage, both a first correction method and a third correction method are applied.

The first correction method involves setting B=A in (Expression 2) so that the dither current large period B and the dither current small period A match each other, to thereby fix the dither duty Γ=B/Td to 50%, and a relationship between the waveform average current Ia serving as the target average current Iaa and the dither medium current I0 serving as the instruction current in the first correction method is calculated by (Expression 2a).

$$Iaa=Ia=I0+0.5\times\Delta I\times((a-b)) \quad \text{(Expression 2a)}$$

The third correction method involves setting, in order to apply the common dither medium current I0 expressed by (Expression 2aa) to a first product having a response time difference (a1−b1) and a second product having a response time difference (a2−b2), where (a2−b2)>(a1−b1), a dither duty Γ2=B2/Td of the second product to be smaller than a dither duty Γ1=B1/Td=0.5 of the first product.

$$Iaa=Ia=I0+0.5\times\Delta I\times((a1-b1)) \quad \text{(Expression 2aa)}$$

In order to equalize a value of (Expression 2) relating to the first product and a value of (Expression 2) relating to the second product to each other, a relationship of (Expression 6) is necessary.

$$(B1-b1)-(A1-a1)=(B2-b2)-(A2-a2) \quad \text{(Expression 6)}$$

In this case, A1=B1=Td/2 and A2+B2=Td are set to acquire (Expression 6a) and (Expression 6b).

$$A2=[Td+(a2-b2)-(a1-b1)]/2 \quad \text{(Expression 6a)}$$

$$B2=[Td-(a2-b2)+(a1-b1)]/2 \quad \text{(Expression 6b)}$$

The dither duty Γ2=B2/Td of the second product is determined with a difference value (a2−b2)−(a1−b1) between the response time differences being used as a correction parameter.

As an average response time difference ((a1−b1)), which is an average of the plurality of samples, and an average difference value ((a2−b2)−(a1−b1)) of the average response time difference, an average response time difference corresponding to a medium value between a minimum value and a maximum value of a practical range of the target average current Iaa or corresponding to a specific representative target average current frequently used is applied, or an average response time difference calculated by interpolation by using a plurality of average response time differences relating to the target average current Iaa on the plurality of stages is applied.

As described above, according to claim 4 of the present invention, on the experimental stage, the dither duty is adjusted so that the waveform average current and the dither medium current match each other, and the response time difference, which is the difference between the fall time and the rise time corresponding to the dither medium current, is measured. Further, as the first correction method on the actual operation stage, the dither duty is fixed to 50%, and the dither medium current corresponding to the waveform average current is calculated by using the average response time difference data acquired on the experimental stage, to thereby apply the dither medium current as the instruction current corresponding to the target average current. As the third correction method, the dither duty of one of the first product and the second product different in the average response time is variably adjusted to carry out the correction by the first correction method.

Thus, such a feature is provided that a simple expression represented as (Expression 2aa) or (Expression 6b) is used to correct and set the dither medium current as the instruction current, the difference between the products is adjusted by correcting the dither duty, and even when the rise time and the fall time of the dither current fluctuate, an appropriate dither medium current is determined as the instruction current in correspondence to the given target average current, thereby reducing the control error.

As apparent from the above description, the dither current power supply control apparatus 100C according to the third embodiment of the present invention includes, as in the first embodiment, the calculation control circuit unit 120C including the current control means 125C, the drive switching device 151 for the proportional solenoid coil 105, and the commutation circuit device 152C. The dither current power supply control apparatus 100C further includes the instruction current setting means 24*a* and the instruction current correction means 24*b* in order to acquire the target average current Iaa and the dither amplitude current ΔI given by the target average current setting means 21*b* and the dither amplitude current setting means 22*bb*. Further, the first correction means 24*b* for setting the dither medium current I0 so as to establish such a relationship that the detected average current Idd of the proportional solenoid coil 105 is equal to the target average current Iaa is applied.

The commutation circuit device 152C is a first product, which is a junction diode having a large forward voltage drop, or a second product, which is an equivalent diode formed of a reverse-conducting field effect transistor whose voltage drop and heat generation are suppressed. A model classification of the commutation circuit device 152C is discriminated by presence or absence of the jumper 156 provided on a circuit board or a model code stored in the program memory 121. The third correction means 23*cc* is used in parallel in addition to the first correction means 24*b*, which is the instruction current correction means for acting on the instruction current setting means 24. The third correction means 23*cc* is dither duty correction means for acting on the dither current amplitude setting means 22*bb* to set, in order to apply the common dither medium current I0 to the first product having a response time difference (a1−b1) and the second product having a response time difference (a2−b2), where (a2−b2)>(a1−b1), a dither duty Γ2=B2/Td of the second product to be smaller than a dither duty Γ1=B1/Td=0.5 of the first product.

As described above, according to claim 6 of the present invention, the dither medium current is set by the instruction current correction means (first correction means) acting on the instruction current setting means to establish such a relationship that the energization average current of the proportional solenoid coil is equal to the target average current. Further, the dither duty correction means is provided, which serves as the third correction means for setting the dither duty for the second product large in the response time difference to be smaller than the dither duty of the first product small in the response time difference. Thus, such a feature is provided that the common instruction current correction means (first correction means) may be applied to the first product and the second product different in the response time difference.

The proportional solenoid coil 105 is provided for each of a plurality of hydraulic solenoid valves for selecting a shift position of a vehicle transmission. Each of a plurality of the proportional solenoid coils 105 includes the drive switching device 151, the current detection resistor 153, and the commutation circuit device 152C. The shared variable constant voltage power supply 159*a* is provided between the external power supply 101, which is an in-vehicle battery, and a plurality of the drive switching devices 151.

The shared variable constant voltage power supply 159*a* is controlled by negative feedback so that an output voltage of the shared variable constant voltage power supply 159*a* matches a variable voltage Vx=Is×R, which is a product of a reference current Is for the proportional solenoid coil 105 and a load resistance R, which is an internal resistance of the proportional solenoid coil 105 at a current temperature, or is adjusted in an ratio based on a power supply duty Γv=Vx/Vbb, which is a ratio of the variable voltage Vx to a power supply voltage Vbb, which is a current voltage of the external power supply 101.

The reference current Is is expressed by an energization current V0/R0 acquired when a resistance value of the proportional solenoid coil 105 is a reference resistance R0, and an applied voltage to the proportional solenoid coil 105 when the drive switching device 151 is closed is a reference voltage V0. The reference voltage V0 is a common fixed value even when the reference resistances R0 and the reference currents Is of the plurality of the proportional solenoid coils 105 are different from one another.

The variable voltage is represented as an expression, Vx=V0×(R/R0). The power supply duty is represented as an expression, Γv=(Is×R)/Vbb=(R/R0)/(Vbb/V0). The plurality of the proportional solenoid coils 105 are used in a common temperature environment and with the common external power supply 101 so that a resistance ratio (R/R0) and a voltage ratio (Vbb/V0) are common, and the variable voltage Vx or the power supply duty Γv is applied in common to the plurality of the proportional solenoid coils 105.

This applies to the first and second embodiments.

As described above, according to claim 7 of the present invention, the power to the plurality of proportional solenoid coils used in the common temperature environment and on the common external power supply is supplied via the shared variable constant voltage power supply. Further, the output voltage of the shared variable constant voltage power supply is controlled by negative feedback so as to be the variable voltage Vx proportional to a resistance ratio (R/R0) of the current load resistance R of the proportional solenoid coil to the reference resistance R0, or by on/off control at an energization duty corresponding to a value acquired by dividing the resistance ratio by a voltage ratio (Vbb/V0) of the current power supply voltage Vbb to the reference voltage V0.

Thus, the voltage applied to the proportional solenoid coil is variably adjusted in response to the fluctuation of the power supply voltage and the fluctuation of the internal resistance due to the temperature change, and hence the current control means may specify the ratio to the reference current to acquire a desired energization current.

Moreover, such a feature is provided that the shared variable constant voltage power supply is shared by the plurality of proportional solenoid coils, which is thus economical, and the current is not supplied simultaneously to all the plurality of proportional solenoid coils, and the power consumption is thus suppressed.

The calculation control circuit unit 120C is configured to cause the command pulse generation means 26*aa* to generate, based on a switching duty determined by the PWM duty setting means 25*aa*, a command pulse signal PLS to indirectly control the drive switching device 151 to be turned on/off via the negative feedback control circuit 160 and the gate circuit 150C. The PWM duty setting means 25*aa* is configured to determine a PWM duty $\gamma=\tau on/\tau$ of the command pulse signal PLS with which the command pulse signal PLS is turned on/off at a PWM cycle $\tau$, and determine a close period $\tau on$ of the PWM duty $\gamma=\tau on/\tau$, which is an on period, so that $\gamma 2=I2/Iamax$ or $\gamma 1=I1/Iamax$, which is a ratio of the dither large current I2 or the dither small current I1 that is an instruction current by the instruction current setting means 24*a*, to a maximum value Iamax of the target average current Iaa is established.

A voltage between both terminals of the current detection resistor 153 is input to the calculation control circuit unit 120C via the amplifier 154, and a detected current Id proportional to a digital conversion value of the voltage is smoothed into the detected average current Idd via the digital filter 27*b*.

The dither amplitude cycle Td in the dither amplitude current setting means 22*bb* is more than an inductive time constant Tx=L/R, which is a ratio of an inductance L of the proportional solenoid coil 105 to a load resistance R of the proportional solenoid coil 105 at a current temperature. The PWM cycle $\tau$ is less than the inductive time constant Tx. A smoothing time constant Tf by the digital filter 27*b* is more than the dither amplitude cycle Td ($Tf>Td>Tx>\tau$).

The negative feedback control circuit 160 is configured to compare, with use of the comparison control circuit 161, an analog command signal At acquired by smoothing the command pulse signal PLS by the first smoothing circuit 160*a* and a current detected signal Ad acquired by smoothing an output voltage of the amplifier 154 by the second smoothing circuit 160*b* to each other, and to open and close the drive switching device 151 to carry out negative feedback control so that the detected current matches a corresponding one of the dither large current I2 and the dither small current I1 independently of presence or absence of a fluctuation in the power supply voltage Vbb and presence or absence of a fluctuation in the load resistance R.

The first smoothing circuit 160*a* and the second smoothing circuit 160*b* each have a smoothing time constant having a value more than the PWM cycle $\tau$ and less than the inductive time constant Tx.

The proportional/integral means 28 is configured to carry out, when a setting error occurs in the instruction current setting means 24*a* constructed by the first correction means 24*b* or a setting error occurs in the dither amplitude current setting means 22*bb* constructed by the third correction means 23*cc* and when a current control error occurs in the negative feedback control circuit 160, negative feedback control to increase and decrease the combined target current It based on an integral of a deviation signal between the target average current Iaa and the detected average current Idd so as to establish such a relationship that the target average current Iaa and the detected average current Idd match each other. An integral time constant Ti of the negative feedback control is more than the dither amplitude cycle Td.

As described above, according to claim 10 of the present invention, the calculation control circuit unit includes, in order to acquire the given target average current and dither amplitude current, the instruction current setting means and the instruction current correction means or the dither duty correction means, sets the dither medium current or the dither duty to establish such a relationship that the energization average current of the proportional solenoid coil is equal to the target average current, and repeats the dither large current period B in which the on duty $\gamma$ of the command pulse signal is proportional to the dither large current I2 and the dither current small period A in which the on duty $\gamma$ of the command pulse signal is proportional to the dither small current I1 at the dither amplitude cycle Td. Further, the negative feedback control circuit carries out the switching control for the drive switching device while monitoring the energization current of the proportional solenoid coil so that the dither large current I2 or the dither small current I1 acquired by smoothing the command pulse signal is acquired. Moreover, the calculation control circuit unit further carries out the negative feedback control of correcting the target current by using the integral of the deviation signal between the target average current and the detected average current so that the target average current and the detected average current match each other.

Thus, the current control for the proportional solenoid coil is carried out by the negative feedback control circuit, and hence such a feature is provided that a control load on the calculation control circuit unit is reduced, and stable and highly precise negative feedback control may be carried out by the instruction current correction means or the dither duty correction means and the double negative feedback control in response to a fluctuation in a wide range of the power supply voltage, the load resistance, or the inductance of the load, and a fluctuation in a required range of the target average current.

The dither amplitude current setting means 22*bb* is configured to generate an increase start command pulse UP and a decrease start command pulse DN to the negative feedback control circuit 160.

The increase start command pulse UP generates a first pulse signal having a predetermined temporal width or a variable temporal width when the energization to the proportional solenoid coil 105 starts, or when the dither amplitude current setting means 22*bb* switches the dither small current I1 to the dither large current I2.

The decrease start command pulse DN generates a second pulse signal having a predetermined temporal width or a variable temporal width when the energization to the proportional solenoid coil 105 stops, or when the dither amplitude current setting means 22*bb* switches the dither large current I2 to the dither small current I1.

The negative feedback control circuit 160 is configured to, in response to the first pulse signal or the second pulse signal, temporally quickly increase or quickly decrease the analog command signal At input to the comparison control circuit 161.

As described above, according to claim 11 of the present invention, the calculation control circuit unit is configured to generate the increase start command pulse UP and the decrease start command pulse DN directed to the negative feedback control circuit, and the negative feedback control circuit is configured to temporally quickly increase/decrease the analog combined target current input to the comparison control circuit in response to the command pulse.

Thus, without relying on a differential circuit for detecting a quick increase/quick decrease in the deviation current between the pulsating analog combined target current and the pulsating analog detected current, stable quick increase/quick decrease control may be carried out based on the quick increase/quick decrease prediction signal from the calculation control circuit unit side, which is the command generation source.

The PWM duty γ of the pulse signal generated by the command pulse generation means 26*aa* takes S/N when a clock signal is counted N times in the PWM cycle τ, and S clock signals out of the N clock signals are on commands. The PWM cycle τ having the N clock signals as one unit is generated n times in the dither amplitude cycle Td. A minimum adjustment unit of the dither duty Γ=B/Td is Td/n.

The command pulse generation means 26*aa* uses second means constructed by the ring register 123*b* in which S on-timings are distributed in N clock signals.

As described above, according to claim 14 of the present invention, the PWM cycles are interposed in the one dither amplitude cycle period n times, the PWM duty γ2 corresponding to the dither large current I2 is set B/τ times out of the n times, and the PWM duty γ1 corresponding to the dither small current I1 is set A/τ times (A+B=n×τ).

Thus, such a feature is provided that a control error that occurs between the target average current and the detected average current due to variations in a current rise characteristic and a current fall characteristic of the proportional solenoid coil may be corrected by the dither duty Γ1=B/(A+B).

The command pulse generation means 26*aa* includes the first and second ring registers 123*b*.

In the dither current large period B, the command pulses PLS are sequentially brought into an on/off state depending on a bit pattern stored in the second ring register 123*b*.

In the dither current small period A, the command pulses PLS are brought into an on/off state depending on a bit pattern stored in the first ring register 123*b*.

The bit pattern corresponding to the PWM duty γ is stored as a data map in the program memory 121.

In the first ring register 123*b*, in the dither current large period B, the data map suitable for the dither small current I1 is read and stored.

In the second ring register 123*b*, in the dither current small period A, the data map suitable for the dither large current I2 is read and stored.

When the PWM duty γ is equal to or less than 50%, and a value of N/S=q is an integer, the bit pattern for generating the on command once and then an off command (q−1) times and generating again the on command once and then the off command (q−1) times is repeated.

When the PWM duty γ is equal to or less than 50%, a quotient of N/S is q, and a remainder is r, the bit pattern for generating the on command once and then the off command (q−1) times or the off command q times and generating again the on command once and then the off command (q−1) times or the off command q times is repeated, and the q off commands are generated r times out of S times of the repetitions.

When the PWM duty γ is more than 50%, based on a complement pattern in which the on and off of the bit pattern used for the PWM duty equal to or less than 50% are inverted, the off command is generated S times out of N times, to thereby attain the PWM duty (N−S)/N.

As described above, according to claim 15 of the present invention, the command pulse generation means is configured so that the on-timings are distributed S times in the generation period of N times of clock signal, to thereby acquire S/N or (N−S)/N as the PWM duty.

Thus, for example, the pulsation is suppressed more in a case where the on command is set once out of five times, and the off command is set the following four times, and repeating this sequence than in a case where the on command is set twice in succession out of ten times, and the off command is set the following eight times. Alternatively, a case where the on command and the off command are alternately repeated is more advantageous than a case where the on command is set five times in succession out of ten times, and the off command is set the following five times. Thus, such a feature is provided that the pulsation in the command signal is suppressed to increase the current control precision.

Moreover, such a feature is provided that the microprocessor does not need to carry out complex calculation in order to distribute the on/off commands, and may use the data map set in advance to easily generate the distributed command signal, thereby suppressing the pulsation in the load current.

What is claimed is:

1. A dither current power supply control method, which comprises calculation control step for generating, for an inductive electric load for driving an actuator having a sliding resistance, a command signal for an instruction current corresponding to a target average current Iaa so that the target average current Iaa and a detected average current Idd match each other, to thereby carry out negative feedback control on an energization current, the target average current Iaa being added with a predetermined dither amplitude current ΔI determined by the sliding resistance, the dither current power supply control method comprising:

setting the dither amplitude current ΔI as a deviation value ΔI=I2−I1 between a saturation estimated value I2 of a dither large current in a dither current large period B within a dither amplitude cycle Td and a saturation estimated value I1 of a dither small current in a dither current small period A (A=Td−B) within the dither amplitude cycle Td so that (Expression 1) is established when a dither medium current is expressed by I0=(I2+I1)/2, $$I2=I0+\Delta I/2, I1=I0-\Delta I/2 \quad \text{(Expression 1);}$$

calculating a waveform average current Ia by (Expression 2), $$Ia=[I2\times(B-b)+I1\times(A-a)+I0\times(b+a)]/Td=I0+0.5\times\Delta I[(B-b)-(A-a)]/Td \quad \text{(Expression 2),}$$

where b represents a rise time during which the energization current increases from the dither small current I1 to the dither large current I2, and a represents a fall time during which the energization current decreases from the dither large current I2 to the dither small current I1, the waveform average current Ia being a value acquired by dividing a time integral of the energization current during the dither amplitude cycle Td by the dither amplitude cycle Td, the dither medium current I0 being calculated so that the waveform average current Ia matches the target average current Iaa, the dither medium current I0 serving as the instruction current for acquiring the target average current Iaa;

energizing and driving, on an experimental stage, the inductive electric load, which is a sample, with the dither large current I2 and the dither small current I1 in the dither amplitude cycle Td, and acquiring, through a measurement or a simulation on a computer, experimentally measured data of a response time difference (a−b) between the rise time b and the fall time a corresponding to the dither medium current I0 on a plurality of stages acquired in the energizing and driving;

storing, on a manufacturing/assembly stage, an approximation equation or a data table of "dither medium current I0 to average response time difference ((a−b))" calculated based on an average of the experimentally measured data acquired with a plurality of samples as a correction parameter in a program memory configured to cooperate with a microprocessor serving as calculation control means for performing the calculation control step; and reading and setting, as a first step of an actual operation stage, the given target average current Iaa and the dither amplitude current ΔI; calculating, as a second step, the instruction current that establishes such a relationship that the waveform average current Ia represented as Expression (2) matches the given target average current Iaa and a dither duty Γ=B/Td, which is a ratio of the dither current large period B to the dither amplitude cycle Td, and setting the instruction current as the dither medium current I0; and carrying out, as a third step, negative feedback by the calculation control means so as to establish such a relationship that the detected average current Idd of the energization current and the target average current Iaa, namely, the waveform average current Ia, match each other.

2. The dither current power supply control method according to claim 1, wherein the acquiring the experimentally measured data comprises, while adjusting the dither duty Γ=B/Td for the predetermined dither medium current I0 with the dither amplitude cycle Td=A+B being set constant, measuring the dither current large period B or the dither current small period A at a time point when the detected average current Idd and the dither medium current I0 match each other, the state in which the dither medium current I0 and the detected average current Idd, namely, the waveform average current Ia, match each other meaning a state in which a difference value (B−b) between the dither current large period B and the rise time b in (Expression 2) and a difference value (A−a) between the dither current small period A and the fall time a are equal to each other, and the dither medium current I0 and the waveform average current Ia match each other, and (Expression 3a) and (Expression 3b) are established, $$A=[(Td+(a-b)]/2 \quad \text{(Expression 3a)}$$

$$B=[(Td-(a-b)]/2 \quad \text{(Expression 3b), and}$$

wherein the correction parameter comprises the approximation equation or the data table of "dither medium current I0 to average response time difference ((a−b))" acquired by carrying out, in an environment at a reference voltage and a reference temperature, experimental measurement on a plurality of samples of the inductive electric load based on the predetermined dither amplitude cycle Td, the dither amplitude current ΔI determined in correspondence to the target average current Iaa, and the dither medium current I0 on the plurality of stages, calculating the response time difference (a−b) by (Expression 4) based on a dither current large period BOO and a dither current small period A00 actually measured in correspondence to the experimental measurement, and setting an average of the plurality of samples as the average response time difference ((a−b)) for the dither medium current I0, $$(a-b)=Td-2\times B00(=2\times A00-Td)\rightarrow \text{average}((a-b)) \quad \text{(Expression 4).}$$

3. The dither current power supply control method according to claim 2, wherein, on the actual operation stage, one of a first correction method and a second correction method is applied, wherein the first correction method comprises setting B=A in (Expression 2) so that the dither current large period B and the dither current small period A match each other, to thereby fix the dither duty Γ=B/Td to 50%, and a relationship between the waveform average current Ia serving as the target average current Iaa and the dither medium current I0 serving as the instruction current in the first correction method is calculated by (Expression 2a), $$Iaa=Ia=I0+0.5\times\Delta I\times((a-b)) \quad \text{(Expression 2a),}$$

wherein the second correction method comprises setting B−b=A−a in (Expression 2) so that the waveform average current Ia serving as the target average current Iaa and the dither medium current I0 serving as the instruction current match each other, and, in correspondence to the dither medium current I0, the dither current large period B or the dither current small period A is calculated by (Expression 5b) or (Expression 5a), and $$A=[(Td+((a-b))]/2 \quad \text{(Expression 5a)}$$

$$B=[(Td-((a-b))]/2 \quad \text{(Expression 5b), and}$$

wherein, as the average response time difference ((a−b)), an average response time difference corresponding to a medium value between a minimum value and a maximum value of a practical range of the target average current Iaa or corresponding to a specific representative target average current frequently used is applied, or an average response time difference calculated by interpolation by using a plurality of average response time differences relating to the target average current Iaa on the plurality of stages is applied.

4. The dither current power supply control method according to claim 2, wherein, on the actual operation stage, both a first correction method and a third correction method are applied, wherein the first correction method comprises setting B=A in (Expression 2) so that the dither current large period B and the dither current small period A match each other, to thereby fix the dither duty Γ=B/Td to 50%, and a relationship between the waveform average current Ia serving as the target average current Iaa and the dither medium current I0 serving as the instruction current in the first correction method is calculated by (Expression 2a), $$Iaa=Ia=I0+0.5\times\Delta I\times((a-b)) \quad \text{(Expression 2a),}$$

wherein the third correction method comprises setting, in order to apply the common dither medium current I0 expressed by (Expression 2aa) to a first product having a response time difference (a1−b1) and a second product having a response time difference (a2−b2), where (a2−b2)>(a1−b1), a dither duty Γ2=B2/Td of the second product to be smaller than a dither duty Γ1=B1/Td=0.5 of the first product, $$Iaa=Ia=I0+0.5\times\Delta I\times((a1-b1)) \quad \text{(Expression 2aa)},$$

wherein, in order to equalize a value of (Expression 2) relating to the first product and a value of (Expression 2) relating to the second product to each other, a relationship of (Expression 6) is necessary, $$(B1-b1)-(A1-a1)=(B2-b2)-(A2-a2) \quad \text{(Expression 6)},$$

wherein A1=B1=Td/2 and A2+B2=Td are set to acquire (Expression 6a) and (Expression 6b), $$A2=[Td+(a2-b2)-(a1-b1)]/2 \quad \text{(Expression 6a)}$$

$$B2=[Td-(a2-b2)+(a1-b1)]/2 \quad \text{(Expression 6b)},$$

wherein the dither duty Γ2=B2/Td of the second product is determined with a difference value (a2−b2)−(a1−b1) between the response time differences being used as a correction parameter, and wherein, as an average response time difference ((a1−b1)), which is an average of the plurality of samples, and an average difference value ((a2−b2)−(a1−b1)) of the average response time difference, an average response time difference corresponding to a medium value between a minimum value and a maximum value of a practical range of the target average current Iaa or corresponding to a specific representative target average current frequently used is applied, or an average response time difference calculated by interpolation by using a plurality of average response time differences relating to the target average current Iaa on the plurality of stages is applied.

5. A dither current power supply control apparatus, comprising a calculation control circuit unit for generating, according on an energization current to a proportional solenoid coil, which is an inductive electric load, for a proportional solenoid valve, which is an actuator for carrying out proportional control on a liquid pressure, a command signal for an instruction current corresponding to a target average current Iaa for the proportional solenoid coil so that the target average current Iaa and a detected average current Idd match each other, to thereby carry out negative feedback control on the energization current, the target average current Iaa being added with a predetermined dither amplitude current ΔI determined by a sliding resistance of a movable valve of the proportional solenoid valve, wherein the proportional solenoid coil is connected in series to a drive switching device for intermittently controlling the energization current of the proportional solenoid coil and connected in series to a current detection resistor, and comprises a commutation circuit device connected in parallel with a series circuit of the proportional solenoid coil and the current detection resistor, wherein the calculation control circuit unit comprises mainly a microprocessor configured to cooperate with a program memory and a calculation RAM memory, and the program memory comprises a control program serving as current control means, wherein the current control means comprises:

target average current setting means for setting the target average current Iaa corresponding to a target pressure with use of a pressure-to-current conversion table;

dither amplitude current setting means for setting a target dither amplitude current ΔI;

instruction current setting means based on a dither combined current acquired by adding the target average current Iaa and the dither amplitude current ΔI to each other; and first correction means or second correction means, wherein a deviation value between the target average current Iaa generated by the target average current setting means and the detected average current Idd is algebraically added to the target average current Iaa via proportional/integral means so as to serve as a combined target current It, wherein the dither amplitude current setting means is configured to repeatedly generate a dither large current I2 and a dither small current I1, which are command signals acquired by adding and subtracting a half of the target dither amplitude current ΔI to and from a dither medium current I0 as a reference with a dither amplitude cycle Td=A+B including a dither current large period B and a dither current small period A, wherein the instruction current setting means is configured to determine the dither large current I2 and the dither small current I1 based on the dither amplitude current ΔI set by the dither amplitude current setting means and the dither medium current I0 determined based on the combined target current It, wherein the first correction means comprises instruction current correction means for acting on the instruction current setting means to correct, with use of a correction parameter measured on an experimental stage, fluctuation errors in a rise time b and a fall time a of the energization current that fluctuate depending on magnitudes of the dither medium current I0 and the dither amplitude current ΔI, and for setting an instruction current having a value different from a value of the target average current Iaa as the dither medium current I0, and wherein the second correction means comprises dither duty correction means for acting on the dither current amplitude setting means to set a dither duty Γ=B/Td, which is a ratio of the dither current large period B to the dither amplitude cycle Td, so as to establish such a relationship that the target average current Iaa and the dither medium current I0 match each other.

6. The dither current power supply control apparatus according to claim 5, wherein the commutation circuit device comprises a first product, which is a junction diode having a large forward voltage drop, or a second product, which is an equivalent diode formed of a reverse-conducting field effect transistor whose voltage drop and heat generation are suppressed, a model classification of the commutation circuit device is discriminated by presence or absence of a jumper provided on a circuit board or a model code stored in the program memory, and third correction means is used in parallel in addition to the first correction means, which is the instruction current correction means for acting on the instruction current setting means, and wherein the third correction means comprises dither duty correction means for acting on the dither current amplitude setting means to set, in order to apply the common dither medium current I0 to the first product having a response time difference (a1−b1) and the second product having a response time difference (a2−b2), where (a2−b2)>(a1−b1), a dither duty Γ2=B2/Td of the second product to be smaller than a dither duty Γ1=B1/Td=0.5 of the first product.

7. The dither current power supply control apparatus according to claim 5, wherein the proportional solenoid coil is provided for each of a plurality of hydraulic solenoid valves for selecting a shift position of a vehicle transmission, each of a plurality of the proportional solenoid coils comprises the drive switching device, the current detection resistor, and the commutation circuit device, and a shared variable constant voltage power supply is provided between an external power supply, which is an in-vehicle battery, and a plurality of the drive switching devices, wherein the shared variable constant voltage power supply is controlled by negative feedback so that an output voltage of the shared variable constant voltage power supply matches a variable voltage Vx=Is×R, which is a product of a reference current Is for the proportional solenoid coil and a load resistance R, which is an internal resistance of the proportional solenoid coil at a current temperature, or is adjusted in an on/off ratio based on a power supply duty Γv=Vx/Vbb, which is a ratio of the variable voltage Vx to a power supply voltage Vbb, which is a current voltage of the external power supply, wherein the reference current Is is expressed by an energization current V0/R0 acquired when a resistance value of the proportional solenoid coil is a reference resistance R0, and an applied voltage to the proportional solenoid coil when the drive switching device is closed is a reference voltage V0, and the reference voltage V0 is a common fixed value even when the reference resistances R0 and the reference currents Is of the plurality of the proportional solenoid coils are different from one another, and wherein the variable voltage is represented as an expression, Vx=V0×(R/R0), the power supply duty is represented as an expression, Γv=(Is×R)/Vbb=(R/R0)/(Vbb/V0), the plurality of the proportional solenoid coils are used in a common temperature environment and with a common external power supply so that a resistance ratio (R/R0) and a voltage ratio (Vbb/V0) are common, and the variable voltage Vx or the power supply duty Γv is applied in common to the plurality of the proportional solenoid coils.

8. The dither current power supply control apparatus according to claim 5, wherein the calculation control circuit unit is configured to cause command pulse generation means to generate, based on a switching duty determined by PWM duty setting means, a drive pulse signal DRV to directly control the drive switching device to be turned on/off via a gate circuit, wherein the PWM duty setting means is configured to operate in response to an instruction current from the instruction current setting means to determine a PWM duty γ=τon/τ, which is a ratio of a close period τon, which is an on period of the drive switching device, to a PWM cycle τ, wherein a voltage between both terminals of the current detection resistor is input to the calculation control circuit unit via an amplifier, and a detected current Id proportional to a digital conversion value of the voltage is smoothed into the detected average current Idd via a digital filter, wherein the PWM duty setting means is configured to initially set the PWM duty γ=τon/τ so as to match ratios I2/Is and I1/Is, which are ratios of the dither large current I2 and the dither small current I1 to a reference current Is, wherein the reference current Is is expressed by an energization current V0/R0 acquired when a resistance value of the proportional solenoid coil is a reference resistance R0, and an applied voltage to the proportional solenoid coil when the drive switching device is closed is a reference voltage V0, or wherein the proportional solenoid coil is supplied with power via a shared variable constant voltage power supply, and the shared variable constant voltage power supply is controlled by negative feedback so that an output voltage of the shared variable constant voltage power supply matches a variable voltage Vx that is proportional to a resistance ratio (R/R0) of a current load resistance R of the proportional solenoid coil to the reference resistance R0, or is controlled to be turned on/off at an energization duty corresponding to a value acquired by dividing the resistance ratio by a voltage ratio (Vbb/V0) of a current power supply voltage Vbb to the reference voltage V0, wherein the PWM duty setting means is further configured to determine a correction duty, which is acquired by multiplying the initially set duty γ=τon/τ by a reciprocal of a voltage correction coefficient Ke=Vbb/V0, which is a ratio of the current power supply voltage Vbb to the reference voltage V0, by power supply voltage correction means, or acquired by multiplying the initially set duty γ=τon/τ by a resistance correction coefficient Kr=R/R0, which is calculated by current resistance correction means and is a ratio of the load resistance R of the proportional solenoid coil at a current temperature to the reference resistance R0, wherein the dither amplitude cycle Td in the dither amplitude current setting means is more than an inductive time constant Tx=L/R, which is a ratio of an inductance L of the proportional solenoid coil to the load resistance R, the PWM cycle τ is less than the inductive time constant Tx, and a smoothing time constant Tf by the digital filter is more than the dither amplitude cycle Td (Tf>Td>Tx>τ), and wherein the proportional/integral means is configured to carry out, when a setting error occurs in the instruction current setting means constructed by the first correction means, when a setting error occurs in the dither amplitude current setting means constructed by the second correction means or the third correction means, or when a setting error occurs in the PWM duty setting means constructed by one or both of the current voltage correction means and the current resistance correction means, negative feedback control to increase and decrease the combined target current It based on an integral of a deviation signal between the target average current Iaa and the detected average current Idd so as to establish such a relationship that the target average current Iaa and the detected average current Idd match each other, where an integral time constant Ti of the negative feedback control is more than the dither amplitude cycle Td.

9. The dither current power supply control apparatus according to claim 8, wherein the calculation control circuit unit further comprises at least one of increased duty setting means or decreased duty setting means for operating in response to a deviation current Ix between the detected current Id and the dither large current I2 and the dither small current I1, which are the command signals alternately generated by the instruction current setting means, wherein the increased duty setting means is configured to act, when the detected current Id is excessively smaller than the target dither large current I2 and when an absolute value of the deviation current Ix is equal to or more than a first threshold, to temporally increase the PWM duty $\gamma=\tau on/\tau$ of the drive pulse signal DRV generated by the command pulse generation means, and to return the PWM duty to the PWM duty $\gamma=\tau on/\tau$ specified by the PWM duty setting means after a time point when the detected current Id increases, approaches, and passes the target dither large current I2, and wherein the decreased duty setting means is configured to act, when the detected current Id is excessively larger than the target dither small current I1 and when the absolute value of the deviation current Ix is equal to or more than a second threshold, to temporally decrease the PWM duty $\gamma=\tau on/\tau$ of the drive pulse signal DRV generated by the command pulse generation means, and to return the PWM duty to the PWM duty $\gamma=\tau on/\tau$ specified by the PWM duty setting means after a time point when the detected current Id decreases, approaches, and passes the target dither small current I1.

10. The dither current power supply control apparatus according to claim 5, wherein the calculation control circuit unit is configured to cause command pulse generation means to generate, based on a switching duty determined by PWM duty setting means, a command pulse signal PLS to indirectly control the drive switching device to be turned on/off via a negative feedback control circuit and a gate circuit, wherein the PWM duty setting means is configured to determine a PWM duty $\gamma=\tau on/\tau$ of the command pulse signal PLS with which the command pulse signal PLS is turned on/off at a PWM cycle $\tau$, and determine a close period $\tau on$ of the PWM duty $\gamma=\tau on/\tau$, which is an on period, so that $\gamma 2=I2/Iamax$ or $\gamma 1=I1/Iamax$, which is a ratio of the dither large current I2 or the dither small current I1 that is an instruction current by the instruction current setting means, to a maximum value Iamax of the target average current Iaa is established, wherein a voltage between both terminals of the current detection resistor is input to the calculation control circuit unit via an amplifier, and a detected current Id proportional to a digital conversion value of the voltage is smoothed into the detected average current Idd via a digital filter, wherein the dither amplitude cycle Td in the dither amplitude current setting means is more than an inductive time constant Tx=L/R, which is a ratio of an inductance L of the proportional solenoid coil to a load resistance R of the proportional solenoid coil at a current temperature, the PWM cycle $\tau$ is less than the inductive time constant Tx, and a smoothing time constant Tf by the digital filter is more than the dither amplitude cycle Td ($Tf>Td>Tx>\tau$), wherein the negative feedback control circuit is configured to compare, with use of a comparison control circuit, an analog command signal At acquired by smoothing the command pulse signal PLS by a first smoothing circuit and a current detected signal Ad acquired by smoothing an output voltage of the amplifier by a second smoothing circuit to each other, and to open and close the drive switching device to carry out negative feedback control so that the detected current matches a corresponding one of the dither large current I2 and the dither small current I1 independently of presence or absence of a fluctuation in the power supply voltage Vbb and presence or absence of a fluctuation in the load resistance R, wherein the first smoothing circuit and the second smoothing circuit each have a smoothing time constant having a value more than the PWM cycle $\tau$ and less than the inductive time constant Tx, and wherein the proportional/integral means is configured to carry out, when a setting error occurs in the instruction current setting means constructed by the first correction means or a setting error occurs in the dither amplitude current setting means constructed by the second correction means or the third correction means and when a current control error occurs in the negative feedback control circuit, negative feedback control to increase and decrease the combined target current It based on an integral of a deviation signal between the target average current Iaa and the detected average current Idd so as to establish such a relationship that the target average current Iaa and the detected average current Idd match each other, where an integral time constant Ti of the negative feedback control is more than the dither amplitude cycle Td.

11. The dither current power supply control apparatus according to claim 10, wherein the dither amplitude current setting means is configured to generate an increase start command pulse UP and a decrease start command pulse DN to the negative feedback control circuit, wherein the increase start command pulse UP generates a first pulse signal having a predetermined temporal width or a variable temporal width when the energization to the proportional solenoid coil starts, or when the dither amplitude current setting means switches the dither small current I1 to the dither large current I2, wherein the decrease start command pulse DN generates a second pulse signal having a predetermined temporal width or a variable temporal width when the energization to the proportional solenoid coil stops, or when the dither amplitude current setting means switches the dither large current I2 to the dither small current I1, and wherein the negative feedback control circuit is configured to, in response to the first pulse signal or the second pulse signal, temporally quickly increase or quickly decrease the analog command signal At input to the comparison control circuit.

12. The dither current power supply control apparatus according to claim 5, wherein the proportional solenoid coil is provided for each of a plurality of hydraulic solenoid valves for selecting a shift position of a vehicle transmission, each of a plurality of the proportional solenoid coils comprises the drive switching device, and comprises a resistance detection circuit connected to at least a pair of the proportional solenoid coils configured such that, when one proportional solenoid coil is supplied with power, another proportional solenoid coil is not supplied with power, wherein the resistance detection circuit is configured to supply a pulse current from a stabilized control voltage Vcc to the proportional solenoid coil in anon-driving state via a sampling switching device and a series resistor having a resistance value Rs larger than the load resistance R, and comprises a second amplifier for amplifying an applied voltage $Vs-Vcc\times R/(R+Rs)$ to the proportional solenoid coil during the supply of the pulse current, to thereby generate a resistance detection signal RDS, wherein the calculation control circuit unit is configured to pulse-drive the sampling switching device, and receive the resistance detection signal RDS during the pulse-drive, to thereby calculate the load resistance R, which is an internal resistance of the proportional solenoid coil at a current temperature, by using an expression $R=Rs\times Vs/(Vcc-Vs)\approx Rs\times Vs/Vcc$, and wherein the proportional solenoid coil is supplied with power via a shared variable constant voltage power supply having an output voltage corrected by a value of the load resistance R, or comprises PWM duty setting means for correcting the energization duty of the drive switching device based on the value of the load resistance R.

13. The dither current power supply control apparatus according to claim 5, wherein a commutation circuit connected in parallel with the proportional solenoid coil comprises a high-speed shutoff circuit configured to be enabled during a shutoff of the energization of the proportional solenoid coil and in a decrease current required period upon a switching transition from the dither large current I2 to the dither small current I1, wherein the high-speed shutoff circuit comprises: an attenuation resistor connected in series to the commutation circuit device; and an additional switching device that is connected in parallel with the attenuation resistor and is opened in the decrease current required period, or comprises a commutation switching device connected in series to the commutation circuit device, and wherein a voltage limiting diode is connected to the commutation switching device, and the commutation switching device is opened in the decrease current required period so that a voltage between both ends of the commutation switching device is limited by the voltage limiting diode.

14. The dither current power supply control apparatus according to claim 5, wherein the PWM duty $\gamma$ of the command pulse signal PLS generated by the command pulse generation means takes S/N when a clock signal is counted N times in the PWM cycle $\tau$, and S clock signals out of the N clock signals are on commands, the PWM cycle $\tau$ having the N clock signals as one unit is generated n times in the dither amplitude cycle Td, and a minimum adjustment unit of the dither duty $\Gamma=B/Td$ is Td/n, and wherein the command pulse generation means comprises a ring counter for counting the clock signal, and is configured to select and use one of first means and second means where the first means is a concentrated type in which an on period is continuous so that the on period corresponds to count values from 1 to S and an off period corresponds to count values from S+1 to N, and the second means is a ring register in which S on-timings are distributed in N clock signals.

15. The dither current power supply control apparatus according to claim 14, wherein the command pulse generation means comprises a first ring register and a second ring register, wherein, in the dither current large period B, the command pulses signal PLS are sequentially brought into an on/off state depending on a bit pattern stored in the second ring register, wherein, in the dither current small period A, the command pulses signal PLS are brought into an on/off state depending on a bit pattern stored in the first ring register, wherein the bit pattern corresponding to the PWM duty $\gamma$ is stored as a data map in the program memory, wherein, in the first ring register, in the dither current large period B, the data map suitable for the dither small current I1 is read and stored, wherein, in the second ring register, in the dither current small period A, the data map suitable for the dither large current I2 is read and stored, wherein, when the PWM duty $\gamma$ is equal to or less than 50%, and a value of N/S=q is an integer, the bit pattern for generating the on command once and then an off command (q−1) times and generating again the on command once and then the off command (q−1) times is repeated, wherein, when the PWM duty $\gamma$ is equal to or less than 50%, a quotient of N/S is q, and a remainder is r, the bit pattern for generating the on command once and then the off command (q−1) times or the off command q times and generating again the on command once and then the off command (q−1) times or the off command q times is repeated, and the q off commands are generated r times out of S times of the repetitions, and wherein, when the PWM duty $\gamma$ is more than 50%, based on a complement pattern in which the on and off of the bit pattern used for the PWM duty equal to or less than 50% are inverted, the off command is generated S times out of N times, to thereby attain the PWM duty (N−S)/N.

* * * * *